US006634818B2

(12) United States Patent
Sato et al.

(10) Patent No.: US 6,634,818 B2
(45) Date of Patent: Oct. 21, 2003

(54) FEEDER, IMAGE-FORMING DEVICE, AND REMAINING AMOUNT DETECTING METHOD

(75) Inventors: Kazuyasu Sato, Kawasaki (JP); Takuzou Ikeyama, Kagoshima (JP); Yoshiya Ishiyama, Kawasaki (JP); Shinzo Tanaka, Kawasaki (JP); Akinori Murata, Kawasaki (JP); Osamu Kajitani, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 254 days.

(21) Appl. No.: 09/818,537

(22) Filed: Mar. 28, 2001

(65) Prior Publication Data

US 2002/0041786 A1 Apr. 11, 2002

(30) Foreign Application Priority Data

Aug. 25, 2000 (JP) ..... 2000-256321

(51) Int. Cl.[7] ..... B41J 13/10
(52) U.S. Cl. ..... 400/624; 347/104
(58) Field of Search ..... 400/624, 638, 400/639, 637, 641; 347/104, 105

(56) References Cited

FOREIGN PATENT DOCUMENTS

JP 6-80275 3/1994

*Primary Examiner*—Lamson Nguyen
(74) *Attorney, Agent, or Firm*—Armstrong, Westerman & Hattori, LLP

(57) ABSTRACT

An object of the present invention is to provide a feeder, image-forming device, and remaining amount detecting method that allows a user to simply and effectively determine upon issuing a print command whether the print command will be executed completely without a loss of paper. The inventive feeder for feeding a recordable medium to a processor part that performs a process comprises: a sheet placement part that can accommodate a plurality of the recordable media in a stack of layered sheets, and rotate and shift to a suitable position for feeding the recordable media to the processor part; and a shift amount indicator part that is configured to rotate in a direction of rotation of the sheet placement part as the sheet placement part rotates, so as to enable a shift amount of the sheet placement part corresponding to a remaining amount of the recordable media to be electrically transmitted to an external device.

7 Claims, 19 Drawing Sheets

FEEDER, IMAGE-FORMING DEVICE, AND REMAINING AMOUNT DETECTING METHOD

BACKGROUND OF THE INVENTION

The present invention relates generally to methods and devices for detecting the amount of recordable medium remaining in a paper cassette or paper tray that stores a plurality of recordable media (e.g., printing paper, and OHP films). The present invention is suitable, for example, for detecting the amount of remaining sheets of paper in an image-forming device such as a printer, a photocopier, and a facsimile unit.

In recent years, equipment for office automation (or automated clerical works), such as a printer and a photocopier, has been widely used in order to make the office operations more efficient, and in many instances a local area network (LAN) environment is established in the office, where more than one personal computer (PC) shares one printer.

The printer typically includes a printing part, a sheet conveyor mechanism, and a sheet feeder. The printing part prints specified information on a sheet of paper that is timely conveyed from the sheet feeder by the sheet conveyor mechanism. The sheet conveyor mechanism includes a plurality of conveyor rollers such as a pick roller and a register roller, (and other conveyor means, e.g., a conveyor belt, etc.), and conveys a sheet of paper through the printing part, from the sheet feeder to an ejection part. The sheet feeder is comprised of a paper tray and/or a paper cassette that feeds a sheet of paper to the sheet conveyor mechanism. The sheet feeder may take on a manual feeding structure that requires a user to place sheets of paper manually on one-by-one basis, or an automatic feeding structure that enables multiple sheets of paper to be fed automatically on one-by-one basis to the sheet conveyor mechanism, and thus only requires a user to place the sheets on a single occasion.

For instance, the paper cassette is configured to be attachable to and detachable from a printer body, and to accommodate approximately 100–500 sheets of paper, so as to facilitate operations of adding and replacing sheets of paper. When sheets of paper are placed in the paper cassette, a paper placement part on which the sheets of paper are placed pivots about an axis provided at one end of the paper placement part, and thereby the topmost sheet is positioned so that the pick roller as part of the sheet conveyor mechanism may be brought into contact with an end of the sheet opposite the pivoted end so as to dispense the sheet.

The paper placement part may pivot in accordance with a remaining amount of sheets on the paper placement part and always be properly positioned so that the pick roller may dispense the topmost sheet. In order to enable a large amount of paper to be placed for use with a high-speed machine or other performance machines handling a large amount of paper, the paper tray that is configured to have the paper placement part movable vertically may be provided so as to bring the topmost sheet of paper into contact with the sheet conveyor mechanism.

The sheet feeder or printer body is generally equipped with an empty sensor that detects a loss of paper. The printer has a controller that receives information from the empty sensor, and indicates on an operation panel of the printer or a display of a PC (via an operation of a printer driver) that paper has run out. Consequently, a user may know that paper has run out during printing.

However, a user of an image-forming device using a conventional automatic sheet feeder mechanism could not easily and effectively determine whether his/her print command would be complete without suspension due to a loss of paper, when he/she provides the print command.

Since the empty sensor can detect a loss of paper, if paper has run out before printing is initiated, a user may fill paper and then execute a print command. However, if paper remains but the remaining amount is not so much as the number of sheets to be printed, a user does not receive a notification of a loss of paper until the last remaining sheet has been printed. Therefore, a user, for example, who wishes to print a large number of sheets over a lunch break may get aware of a loss of paper after the lunch break, and inefficiently has no other choice but to retry that printing which is suspended halfway from a page that could not be printed.

In order to solve the above problems, several methods for indicating the remaining amount of paper other than the empty sensor have been proposed. For example, one of the methods provides a transparent window in a cassette for visual inspection. However, this method requires a user to stand near a printer, and thus is disadvantageously inconvenient. Particularly, in a LAN environment, where a printer is shared among more than one user, the users usually cannot have the printer near their seats. Moreover, only the visual inspection of a batch of paper disadvantageously cannot provide the accurate number of the paper.

Accordingly, another method has been proposed for detecting the remaining amount of paper using a lever brought into contact with a top surface of paper, so that a transmission-type sensor detects a varied thickness of the butch of paper or an encoder detects an angular variation of the lever. Yet another method has been proposed using a reflection-type sensor or the like to directly detect the remaining amount of paper. These methods would increase complexity of the structure for detecting the remaining amount of paper due to requirement for provision of the lever, or the like, and thus the size and cost of the device would increase. In addition, variation in contact positions of the lever with paper would decrease the reliability of the detection of the remaining amount of paper. Further, these methods would rely only on an actual amount of paper remaining, and thus be unsuitable for use in a LAN environment in particular. To be more specific, supposing that print commands from more than one user who works in a LAN environment are pending in a queue, for example, when three users see a message displayed on their PCs that a current remaining amount of paper in the printer is 70 sheets, and each user gives a print command to print 30 sheets respectively to the printer, each user believes that his/her own print command would successfully be executed, but the last print command would fail to complete due to a loss of paper.

BRIEF SUMMARY OF THE INVENTION

Therefore, it is an exemplified general object of the present invention to provide a novel and useful feeder, image-forming device, and remaining amount detecting method in which the above conventional disadvantages are eliminated.

Another exemplified and more specific object of the present invention is to provide a feeder, image-forming device, and remaining amount detecting method that allows a user to easily and effectively determine whether his/her print command would be complete without suspension due to a loss of paper, when he/she provides the print command.

In order to achieve the above objects, a feeder as one exemplified embodiment of the present invention is a feeder that feeds a recordable medium to a processor part that performs a process, and comprises: a sheet placement part that can accommodate a plurality of the recordable media in a stack of layered sheets, and rotate and shift to a suitable position for feeding the recordable media to the processor part; and a shift amount indicator part that is configured to rotate in a direction of rotation of the sheet placement part as the sheet placement part rotates, so as to enable a shift amount of the sheet placement part corresponding to a remaining amount of the recordable media to be electrically transmitted to an external device. The feeder includes a shift amount indicator part that is configured to rotate in a direction of rotation of the sheet placement part as the sheet placement part rotates, and thus may directly detect the shift amount of the sheet placement part without the need for an additional means such as a lever. The shift amount indicator part electrically transmits the shift amount, and thus serves to have errors reduced compared with a visual inspection, and to ensure high reliability. Electrical transmission of the shift amount allows not only a user near the image-forming device body (e.g., a printer and a facsimile unit) but also users of PCs connected to the image-forming device to keep track of the remaining amount of the recordable media. In other words, the above external device may include the device body having a printing part, and apparatuses connected with the device.

An image-forming device according to the present invention comprises: a feeder including a sheet placement part that can accommodate a plurality of recordable media in a stack of layered sheets, and rotate and shift to a suitable position for feeding the recordable media, and a shift amount indicator part that is configured to rotate in a direction of rotation of the sheet placement part as the sheet placement part rotates, so as to indicate a shift amount of the sheet placement part; a printing part that performs printing onto the recordable media; a sheet conveyor mechanism that conveys the recordable media fed from the sheet placement part in the feeder through the printing part; a detector that detects the shift amount of the sheet placement part indicated by the shift amount indicator part; and a controller that calculates a remaining amount of the recordable media stored in the sheet placement part based upon the shift amount of the sheet placement part detected by the detector. This image-forming device may calculate a remaining amount of recordable media stored in the sheet placement part with a simple structure.

A remaining amount detecting method according to the present invention comprises the steps of: detecting a shift amount of a sheet placement part that is configured to accommodate a plurality of recordable media and to be shiftable according to the number of sheets of the recordable media; calculating a remaining amount of the recordable media stored in the sheet placement part from the shift amount; calculating an amount of the sheets which will remain after a print command is executed by subtracting from the remaining amount the number of sheets which has not been printed yet but is included in the print command; and indicating the amount of the sheets which will remain after a print command is executed in response to the print command. This remaining amount detecting method calculates not only an amount of recordable media which remains at present, but also that which will remain in future (i.e., after print commands are completely executed) in advance, and may thus allow each user to be notified at the time of providing his/her print command whether the print command will successfully be executed. This advantage will be preferred particularly if a plurality of print commands are pending in one printer in a LAN environment. Moreover, this remaining amount detecting method may be embedded in a printer driver and distributed in a CD-ROM or other computer-readable media.

Other objects and further features of the present invention will become readily apparent from the following description of the embodiments with reference to accompanying drawings.

BRIEF DESCRIPTION OF THE DRAWINGS

FIG. 17 is a flowchart showing a control of the image-forming device shown in FIG. 1 when the image-forming device is powered on.

DETAILED DESCRIPTION OF THE INVENTION

Figure 1:
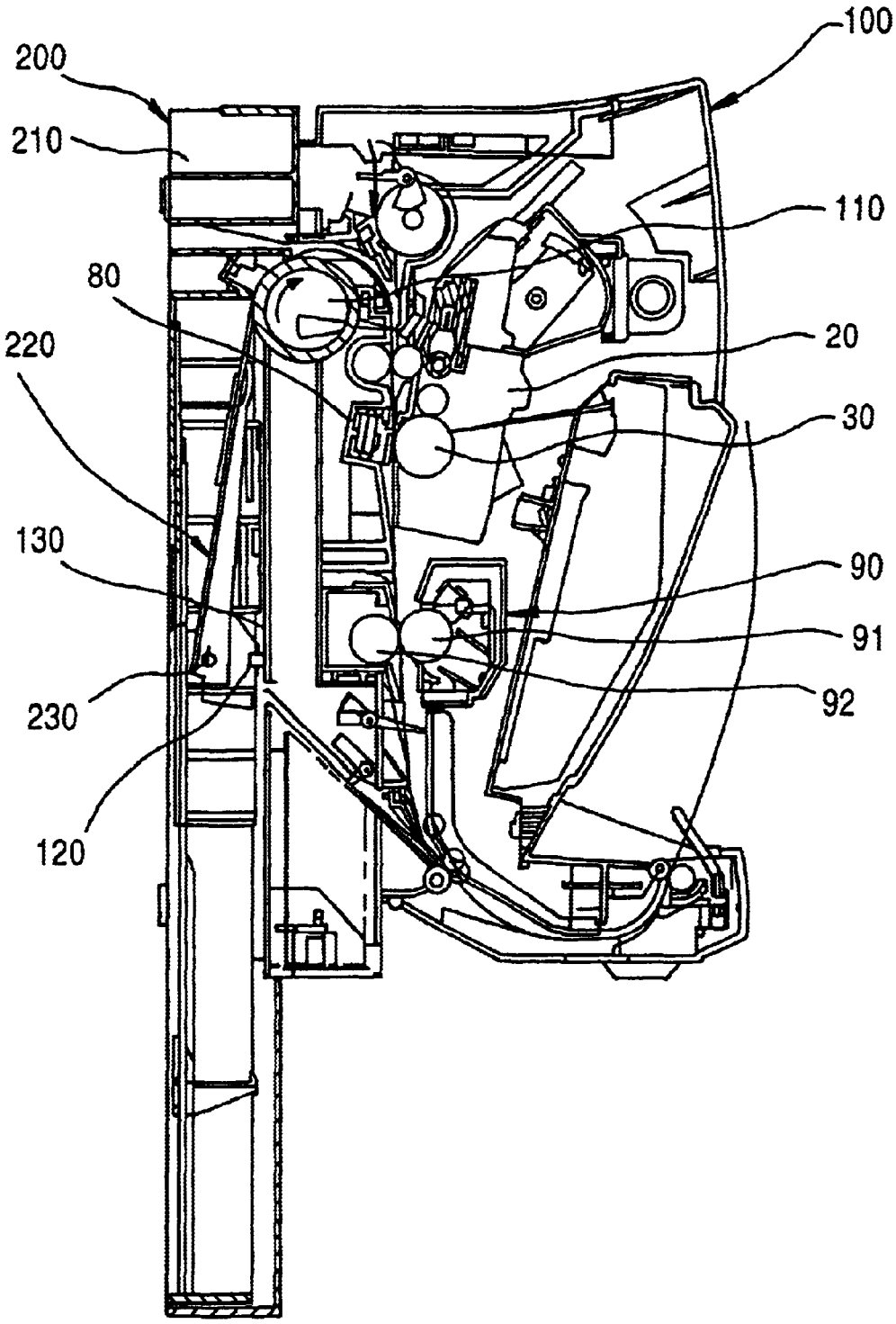
FIG. 1 is a schematic sectional view of an image-forming device having a feeder as one exemplified embodiment of the present invention.
Figure 2:
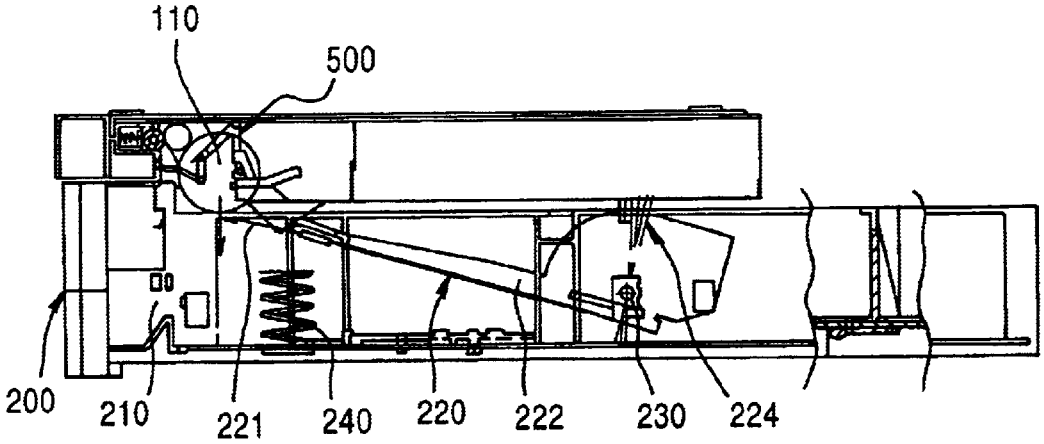
FIG. 2 is a schematic sectional view of the feeder shown in FIG. 1.

With reference to the drawings, a description will be given of a feeder 200 and an image-forming device 100 having the feeder 200 according to the present invention. Although the image-forming device 100 as an embodiment of the present invention is described herein as a laser printer, the present invention is not limited thereto, and broadly applied to a facsimile unit, photocopier, or the like. In each figure, those elements designated by the same reference numerals denote the same elements, and a duplicate description thereof will be omitted. Hereupon, FIG. 1 is a schematic sectional view of the image-forming device 100 having the feeder 200 as one exemplified embodiment of the present invention. FIG. 2 is a schematic sectional view of the feeder 200.

The image-forming device 100 includes a controller 10, a printing part 20, a sheet conveyor mechanism 60, a feeder 200, a remaining paper amount sensor 120, and a cam 150.

A pick roller 110, which is also called a sheet feed roller or a pickup roller, forms part of the sheet conveyor mechanism 60, and conveys a sheet of paper fed from the feeder 200 to a transfer unit 80. The pick roller 110 is pivoted on a pick roller shaft 115 mounted in a main body of the device 100, and placed immediately above a front edge of paper. The pick roller 110 is brought into contact with a topmost sheet of stacked paper and conveys the same to the transfer unit 80 utilizing a rotary action and a frictional force between a surface of the sheet and the pick roller 110. The pick roller 110 is made of a material with a high coefficient of friction such as rubber or the like that facilitates separating the topmost sheet from the stack against a frictional force or electrostatic force between sheets of the stacked paper. It is essential only that the pick roller 110 be configured to convey a sheet of paper, and thus the pick roller 110 may be located either in the feeder 200 or the image-forming device 100.

When a sheet of paper is conveyed, the pick roller 110 is driven to rotate clockwise in FIGS. 1 and 2 together with the roller shaft 115 by a motor 65 that will be described later with reference to FIG. 21. This direction of rotation is a normal direction of the pick roller 110 and the roller shaft 115 for conveying a sheet of paper. Additionally, the pick roller 110 and the roller shaft 115 may rotate counterclockwise in FIGS. 1 and 2 (i.e., in a reverse direction), too. Such rotation in the reverse direction is used to shift a pressure plate 220 to a home position as will be described later.

The feeder 200 serves to store multiple sheets of paper and to feed the sheets of paper to the sheet conveyor mechanism 60, and typically includes a cassette 210 as a housing, and a pressure plate 220 as a paper placement part movable in the cassette 210.

The cassette 210 is configured to be attachable to and detachable from the image-forming device 100 along a frame 130 provided in a main body of the image-forming device 100, and formed, for example, of plastics. The pressure plate 220 serves as a paper placement part, and accommodates 100 through 500 sheets of paper. The feeder 220 may include several cassettes for each applicable size of paper, or a single cassette ready for several types of paper different in size. Each of the cassettes may be formed as a unit, and stacked one on another under the main body, to dispense sheets of paper from each cassette. A sensor (not shown) can detect whether the cassette 210 is fitted into the frame 130.

Figure 3:
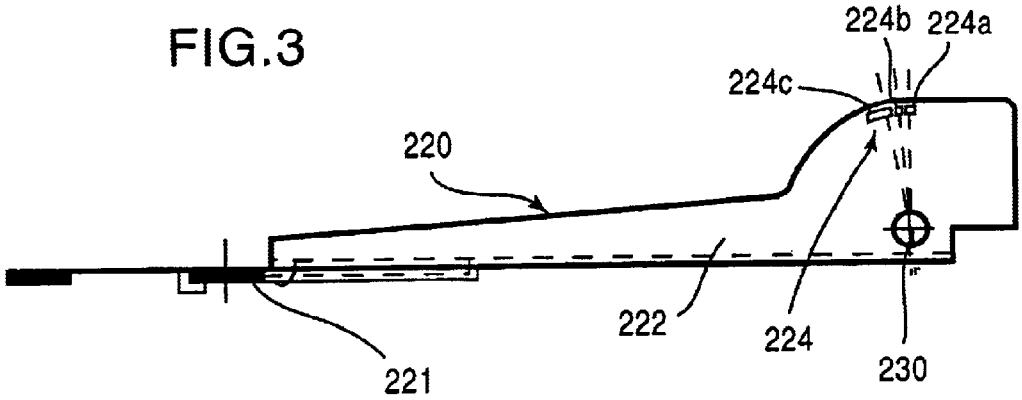
FIG. 3 is an enlarged side view of a pressure plate shown in FIG. 2.

FIG. 3 is a schematic side view of the pressure plate 220. The pressure plate 220 is made of a plate-shaped member, and located at a bottom of the cassette 210 that is a housing. The pressure plate 220 is formed, for example, of plastics. The pressure plate 220 comprises a paper placement part 221 on which sheets of paper are placed, a pair of paper guide parts 222 that forms sidewalls extending upwardly from the paper placement part 221. The paper placement part 221 has a rectangular shape, and forms part of a bottom surface of the cassette 210, so that sheets of paper are placed thereon. In this configuration, the paper placement part 221 is located between the sheets of paper and the bottom of the cassette 210. The paper guide parts 222 erect at two opposite sides of the paper placement part 221 parallel to a sheet conveying direction. The paper guide parts 222 may be formed, for example, integrally with the paper placement part 221 by bending one plate-shaped member, or otherwise. Each paper guide part 222 includes a pivot stud 230 that is fitted into the cassette 210 at a rear end (right side of the paper guide parts in the figure), so that the pressure plate 220 may pivot thereon. When sheets of paper are placed in the cassette 210, the sheets are preferably placed so that the top of the sheets toward the sheet conveying direction may be substantially aligned with a front end (left side of the pressure plate in the drawing) of the pressure plate 220. The pressure plate 220 is configured to be shiftable (pivotable) on the pivot stud 230 from a position parallel to a bottom surface of the feeder 200 (hereinafter referred to as a home position) to the pick roller 110. In the present embodiment, the pressure plate 220 may shift down to a position slightly below the home position. When the cassette 210 stores the maximum number of sheets of paper, the pressure plate 220 is preferably located at the home position. With the pressure plate 220 at the home position, the sensor 120 generates an ON signal. With the pressure plate 220 shifted from the home position to the pick roller side, the sensor 120 generates ON/OFF signals. The home position serves as a reference position for detecting a shift amount of the pressure plate 220, but as far as the pressure plate 220 can serve to detect the shift amount, it does not matter whether the pressure plate 220 at the home position is parallel to the bottom surface of the feeder 200.

Figure 4:
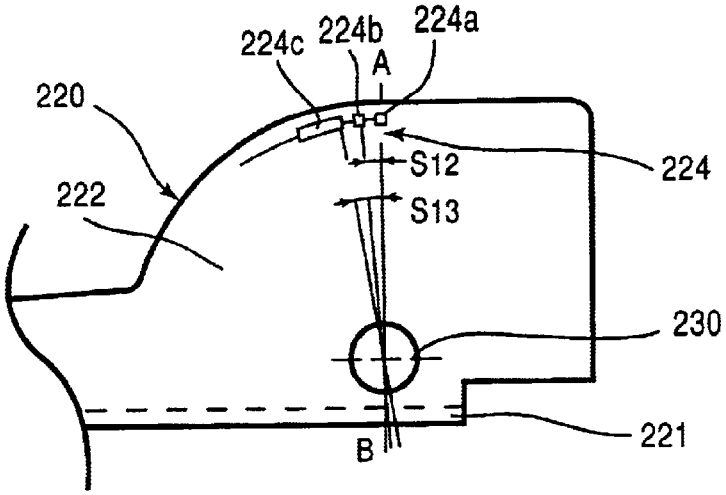
FIG. 4 is a partially enlarged side view of a rear end of the pressure plate shown in FIG. 3.

FIG. 4 is a partially enlarged side view of the rear end of the pressure plate 220. The pressure plate 220 includes a slit set 224 that indicates a shift amount of the pressure plate 220 on one of the paper guide parts 222. The slit set 224 is formed directly on the paper guide part 222 concentric with the pivot stud 230, and serves as an encoder. The paper guide part is thus used as an encoder, and therefore contributes to saved space and reduced cost in the device 200 because the pressure plate 220 may dispense with a separate member as an encoder. Alternatively, a circular plate-shaped member as a separate encoder may be attached concentric with the pivot stud 230 to the paper guide part 222. Compared with a conventional remaining paper amount detecting method using a lever and an encoder, the instant embodiment only requiring an encoder attached to the paper guide part would contribute more to saved space and reduced cost in the device. In addition, the encoder is not limited to that which has a slit shape, but may be shaped like projections and depressions. The encoder thus shaped without limitation would resultantly place no limitations on types of the sensor used in cooperation with the encoder.

The slit set 224 rotates along with the pressure plate 220. The slit set 224 enables the sensor 120 to optically detect an amount of change in angle of rotation (i.e., shift amount) of the pressure plate 220 corresponding to the remaining amount of paper and thereafter to electrically notify a detection result thereof to the controller 10. The slit set 224, as requiring no visual inspection of the remaining amount of paper for a user, increases the reliability of detection of the remaining amount of paper.

The slit set 224, as shown in FIG. 4, includes three slits 224*a* through 224*c* arranged on a circle concentric with the pivot stud 230 (within a range that allows the sensor 120 to detect the slits). The slits 224*a* and 224*b* have the same width, but the slit 224*c* has a greater width than the slits 224*a* and 224*b*. The slit 224*a* is located on a straight line AB passing through the pivot stud 230 and perpendicular to the bottom of the pressure plate 220. The slit 224*b* is so located as to form an angle of S12 with the line AB. S12 is an angle formed by the paper placement part 221 with the home position on the pivot stud 230, for example, when 150 sheets of paper remain in a cassette accommodating 250 sheets. The slit 224*c* is so located as to form an angle of S13 with the line AB. S13 is an angle formed by the pressure plate 220 with the home position on the pivot stud 230, for example, when 50 sheets of paper remain in the same cassette as above. In the present invention, the slit set 224 includes three slits to detect the remaining amount of paper on a one-to-five scale (though one-to-six scale if the remaining amount=0 is counted), but the number of slits is not limited to three. According to the present embodiment, the remaining amount of paper may be detected on a scale of one to (2n−1) where the number of slits is n.

Figure 6:
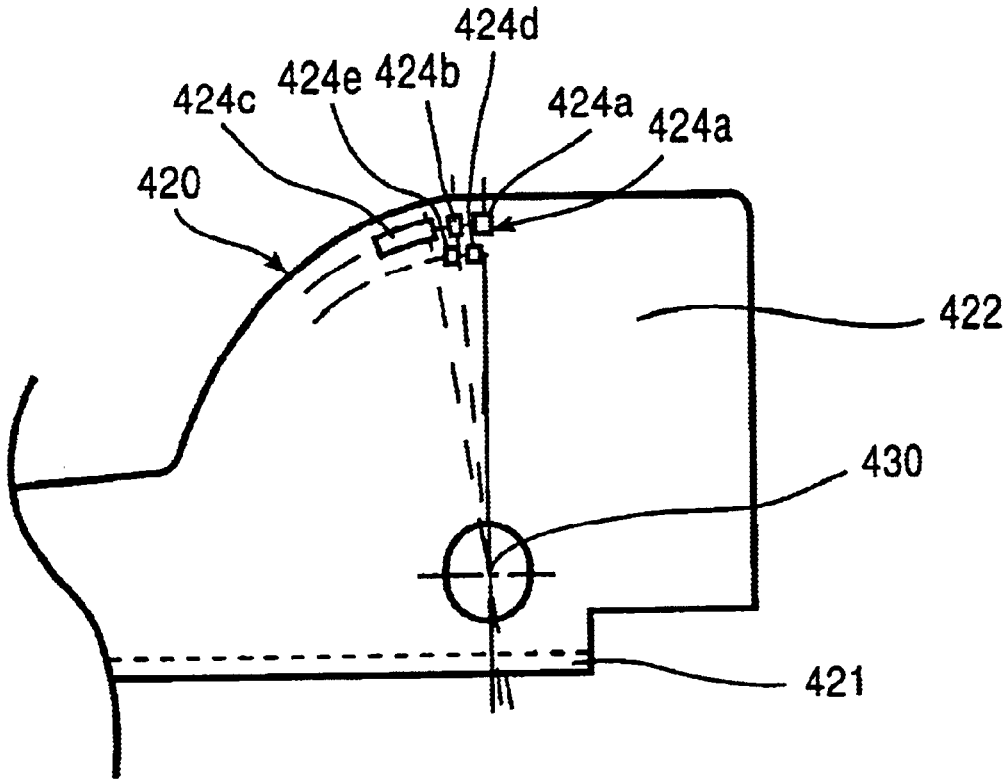
FIG. 6 is a partially enlarged side view of the rear end of the pressure plate shown in FIG. 3 when a slit set is provided with slits arranged in two tiers.

The pressure plate 220 may include a slit set with slits arranged on a plurality of concentric circles. For instance, as shown in FIG. 6, the pressure plate 220 may be substituted by another pressure plate 420 including a slit set 424 with slits arranged in two tiers. The pressure plate 420 is different from the pressure plate 220 only in slit set structure. Hereupon, FIG. 6 is a partially enlarged side view of the rear end of the pressure plate 420 as a variation of the pressure plate 220.

The slit set 424 includes three outside slits 424*a* through 424*c* corresponding to 224*a* through 224*c*, and two inside slits 424*d* and 424*e*. The upper (outside) tier and lower (inside) tier of slits are located respectively in a position different in topology from each other. The slit set with multi-tier slits in which each tier is provided in a position different in topology as described above would graduate a detection scale for a remaining amount of paper into fine divisions (e.g., from 50 sheets to 25 sheets), and improve detection accuracy. Since the arrangement of slits as shown in FIG. 6 can secure a wide interval of each slit, a detection error which the sensor 120 could make due to vibration of the pressure plate 220 if the slits were arranged at short intervals would be prevented, but the present invention places no limitation on structures of the pressure plate 220 to such as shown in FIG. 4, and may be applied to those having five slits as described above. A detailed description will be given later of improvement of detection accuracy with reference to FIGS. 5 and 7. In short, the above-described configuration would lead to the improvement of detection accuracy. Although the above pressure plate 220 includes the slit set 224 only on one of the paper guide parts 222, the slit set may alternatively be provided on both of the paper guide parts 222 to improve detection accuracy. In such a configuration, no restriction is put on the numbers of slits or tiers in each slit set.

The sensor 120 is a detector that is provided on the frame 130 of the image-forming device 100, and detects an angle of rotation of the pressure plate 220 in cooperation with the slit set 224. The number of sensors 120 provided in the device is the same as that of tiers in the slit set(s). The sensor 120 according to the present embodiment is a light-transmission-type photointerrupter having a light-emitting part and a light-receiving part. This type of sensor is configured to have a shading object passing between the light-emitting part and the light-receiving part, and thus has the advantages in ensuring a large signal output, and in not requiring high accuracy in position of the shading object, and the like. However, the present invention places no limitation on types of the sensor 120, and may be applied to a reflection-type photointerrupter.

A light beam emitted from the light-emitting part in the photointerrupter is input from the light-receiving part, and converted into a digital signal. A light-emitting diode (or LED) or the like is used for the light-emitting part, and a phototransistor, a photo IC, a photodiode, or the like is used for the light-receiving part. The present embodiment utilizes an optical sensor for the sensor 120, but sensors applicable to the present invention is not limited to the optical sensor. Moreover, although the sensor 120 is located in such a position as to permit a detection of a shift variation amount of the pressure plate 220 in cooperation with the slit set 224, the position is not limited to a place on the frame 130.

Figure 9:
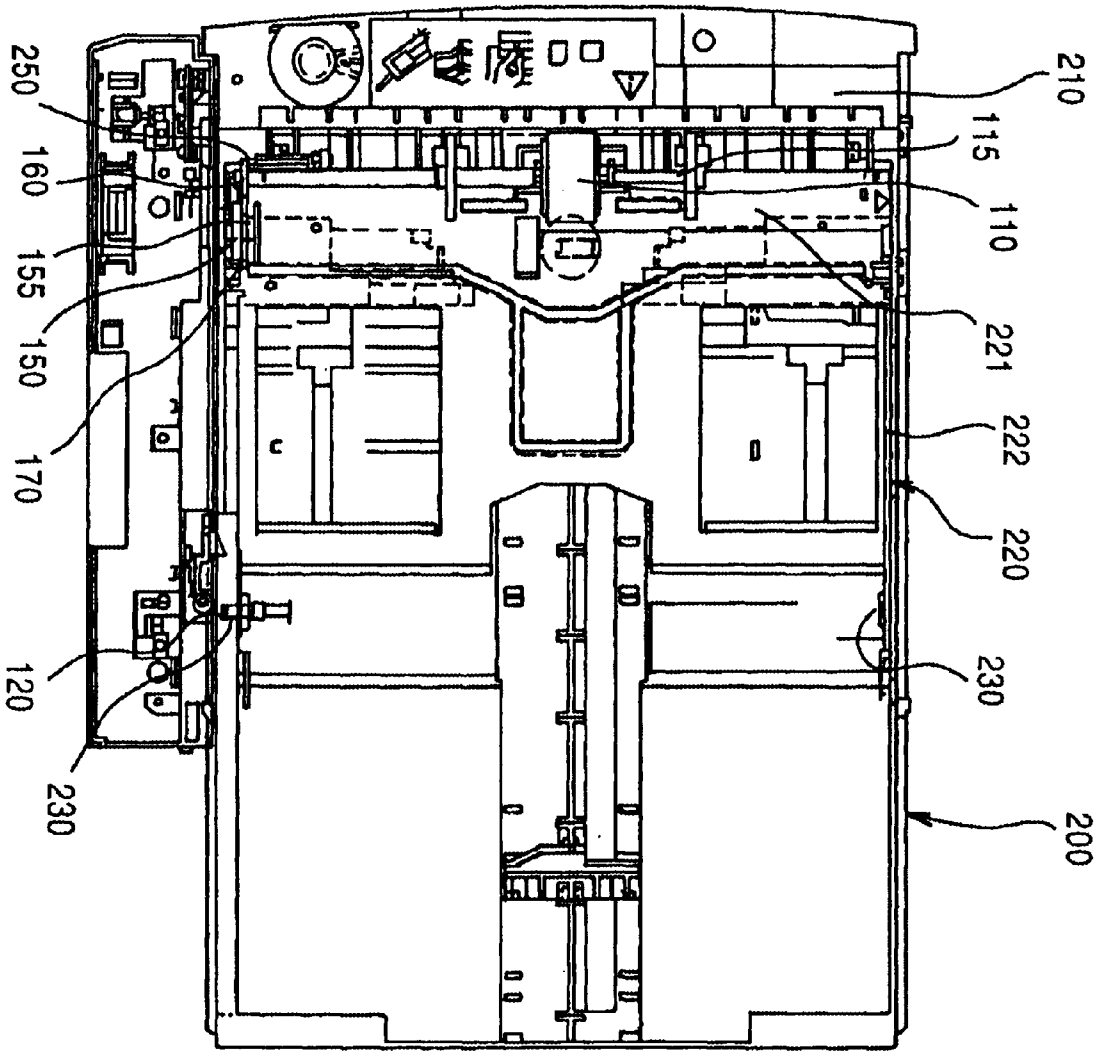
FIG. 9 is a sectional view of the image-forming device shown in FIG. 1.
Figure 11:
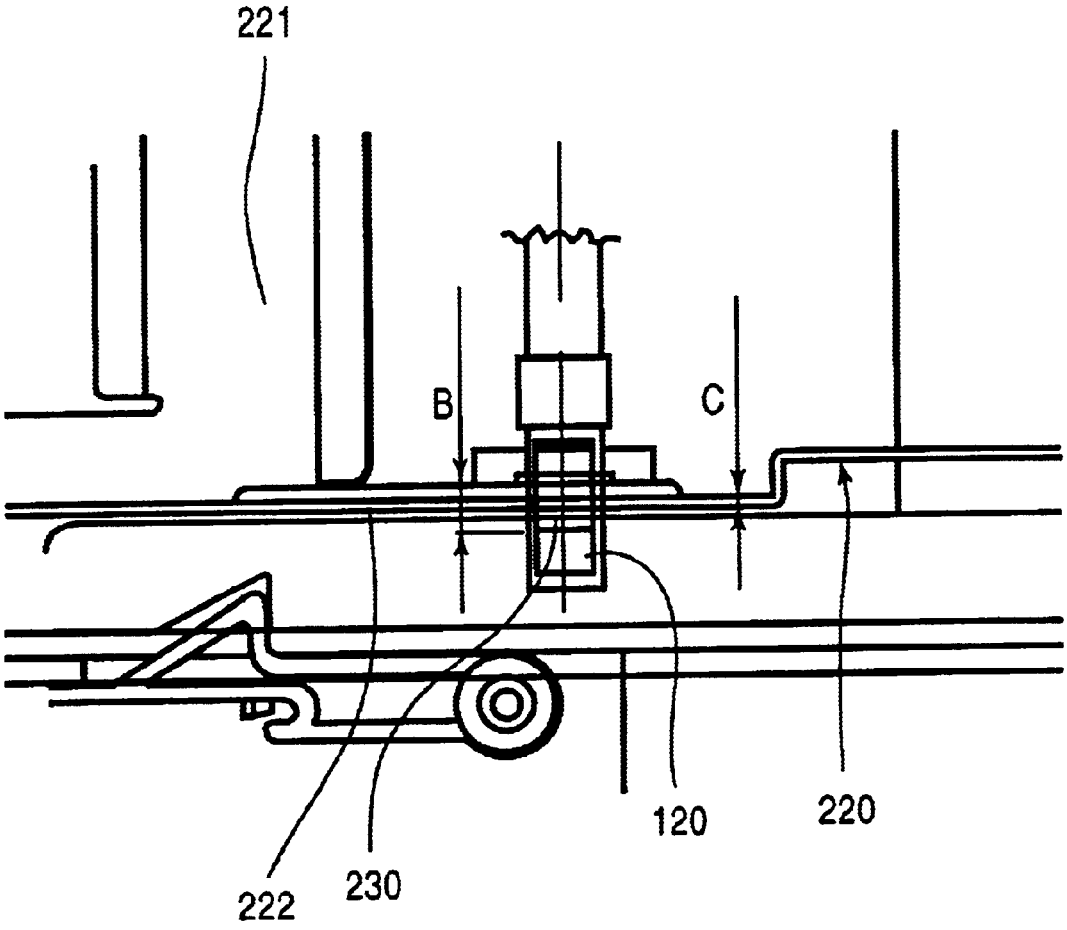
FIG. 11 is a partially enlarged plan view of the image-forming device near the sensor shown in FIG. 9.

As shown in FIGS. 9 and 11, the sensor 120 is located so that the paper guide part 222 having a width C in the pressure plate 220 passes through a gap with a width B between the light-emitting part and the light-receiving part, when the cassette 210 is inserted. The sensor 120 is located so that the light passes through the slit 224*a*, when the cassette 210 is inserted in the frame 130 and the pressure plate 220 is in the home position. FIG. 9 is a sectional view of the image-forming device 100, and FIG. 11 is a partially enlarged plan view of the image-forming device near the sensor 120 shown in FIG. 9.

In the present embodiment, the sensor 120 provides varied output signals as the slit set 224 passes the sensor 120. To be specific, the sensor outputs a High signal when the light passes through a slit, while the sensor outputs a Low signal when the light passes through a portion between slits. In the present invention, the number of variations of the output signals is counted, and thereby a shift amount of the pressure plate 220 is detected. Such a counting operation is carried out by the controller 10 that receives information from the sensor 120. Although an actual operation of the sensor 120 is just to electrically output a signal, the sensor 120 is assumed to be a detector that indirectly carries out the counting operation in a broad sense, and so described in the present application.

Figure 12:
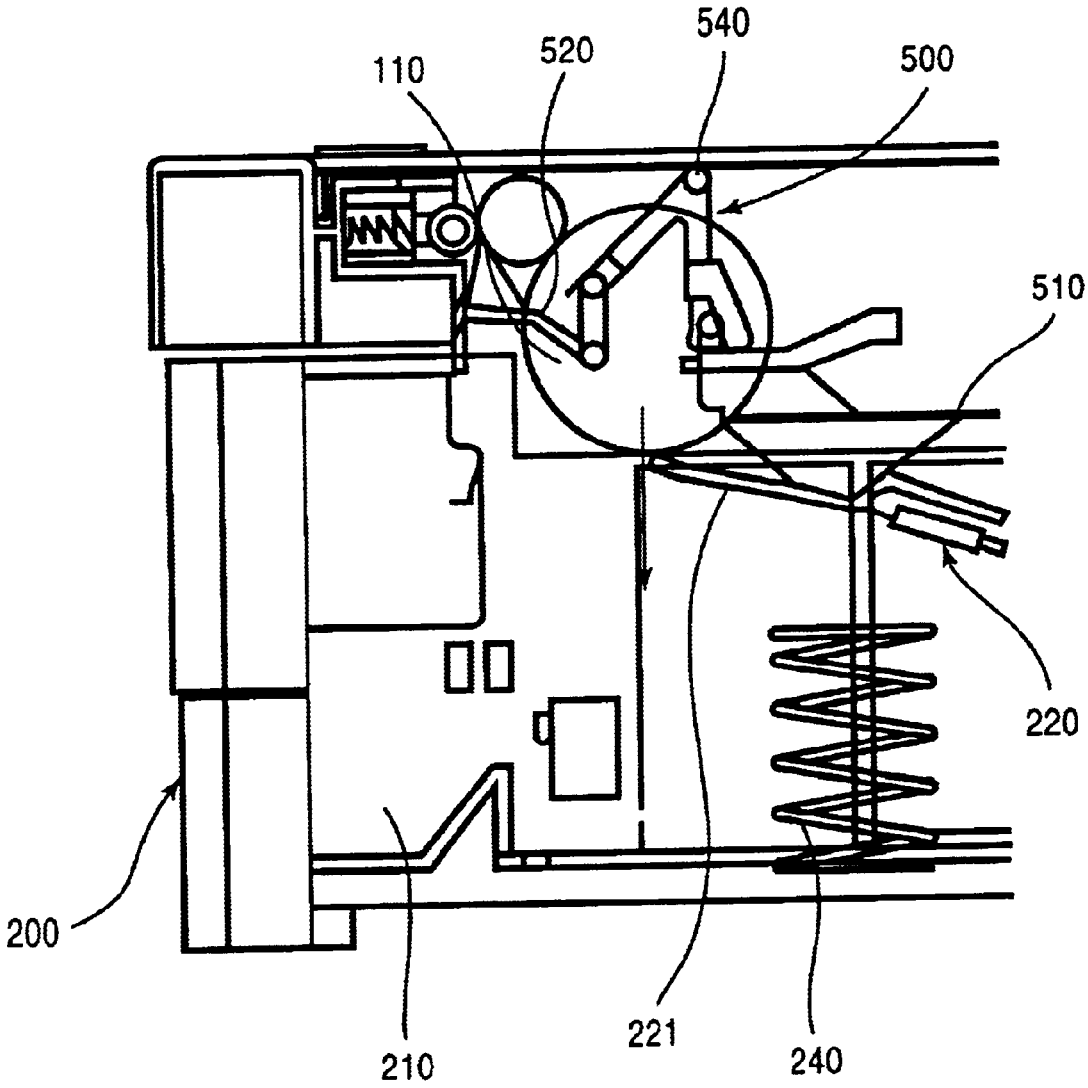
FIG. 12 is a schematic sectional view of an empty sensor used for the image-forming device shown in FIG. 1.

The image-forming device 100 includes an empty sensor 500 that detects a loss of paper. As shown in FIG. 12, when paper runs out, a filler 510 drops into a notch (not shown) in the paper placement part 211. FIG. 12 is a partially enlarged sectional view of the image-forming device 100 near the empty sensor 500. A shielding plate 520 fixed on the filler 510 rotates about a fixing part 540, and thus shields a photosensor (not shown). The shielding by the shielding plate 520 turns the photosensor OFF, so that a loss of paper is detected. For the sensor, a proximity switch, a photosensor, a microswitch, or the like may be used. An optical signal detected by the above-described sensor 120 and the photosensor is thereafter converted into an electric signal, and transmitted via a wiring or other communication medium to the controller 10 that will be described later.

A compression spring 240 is located between the bottom of the cassette 210 and the pressure plate 220, and the pressure plate 220 is constantly pressed upward by an elastic force of the compression spring 240. Consequently, sheets of paper, irrespective of the number thereof, on the pressure plate 220 are brought into contact with the pick roller 110. The present embodiment employs the compression spring 240, but any mechanism having the function of pressing the pressure plate 220 toward the pick roller 110 may be applied to the present invention.

Figure 8:
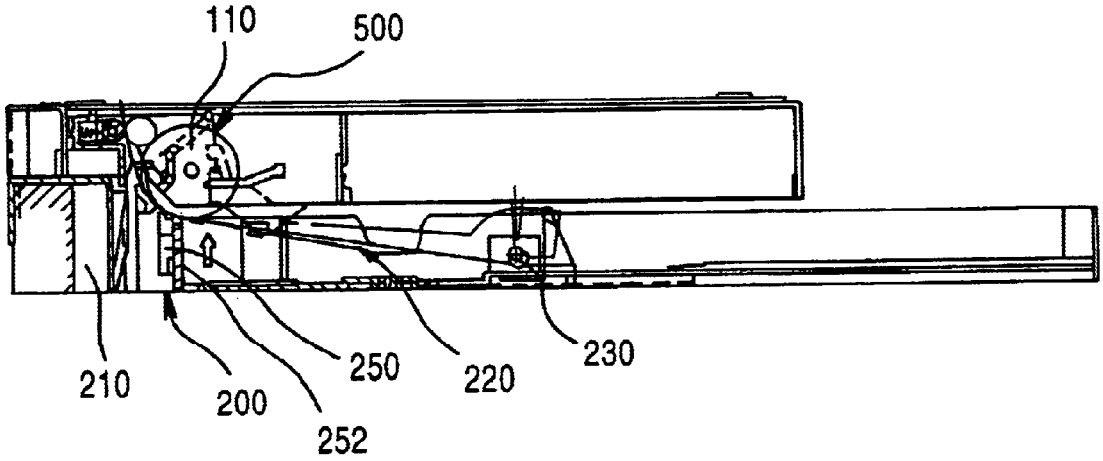
FIG. 8 is a sectional view for explaining a lock lever in the feeder shown in FIG. 2.
Figure 10:
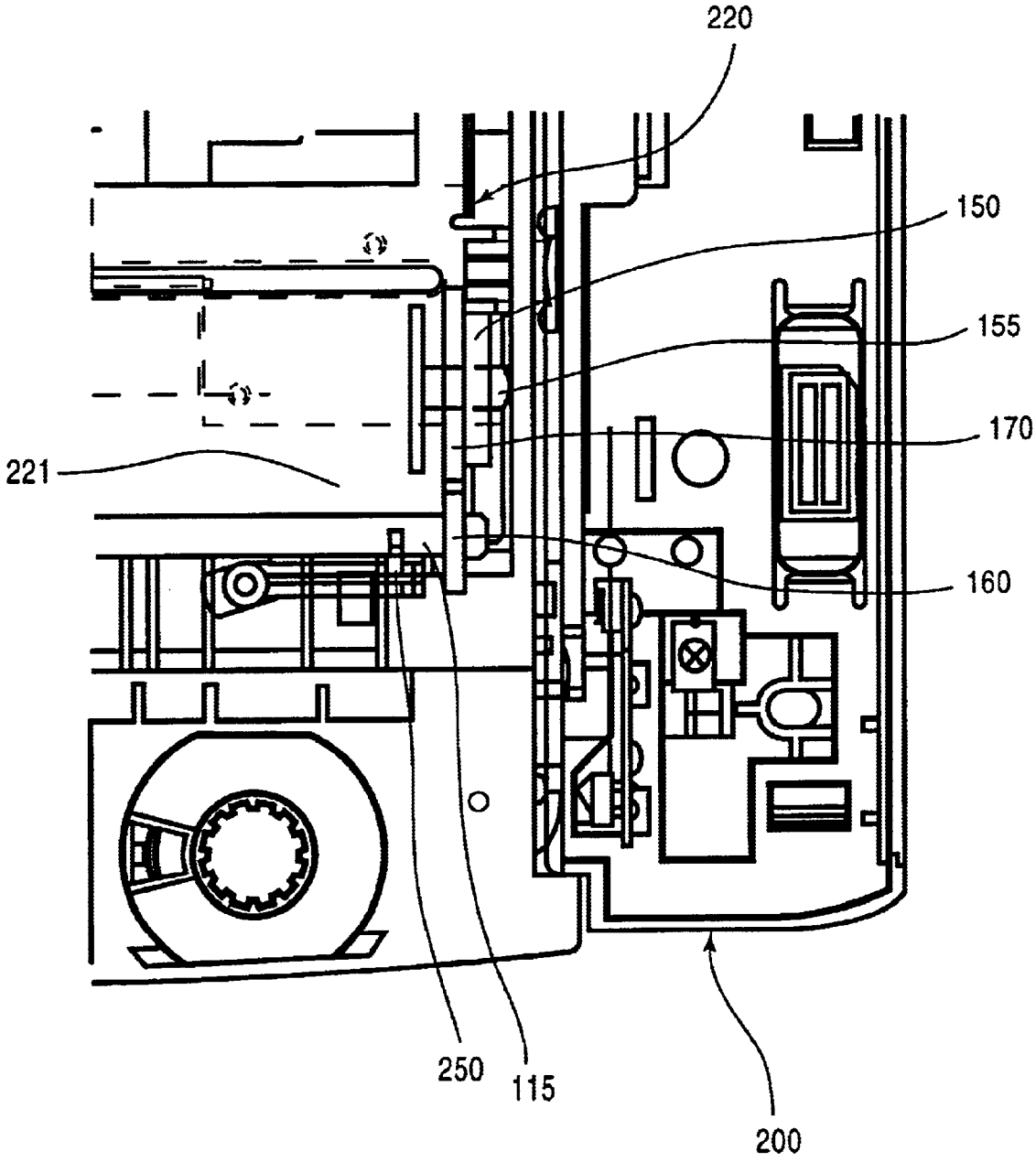
FIG. 10 is an enlarged plan view of a portion of the feeder near the lock lever shown in FIG. 8.

Referring to FIGS. 8 and 10, the cassette 210 includes a lock lever 250 that fixes the pressure plate 220 in the home position. FIG. 8 is a sectional view for explaining a structure of the lock lever 250 in the feeder 200. FIG. 10 is a partially enlarged view in the vicinity of the lock lever.

Figure 22:
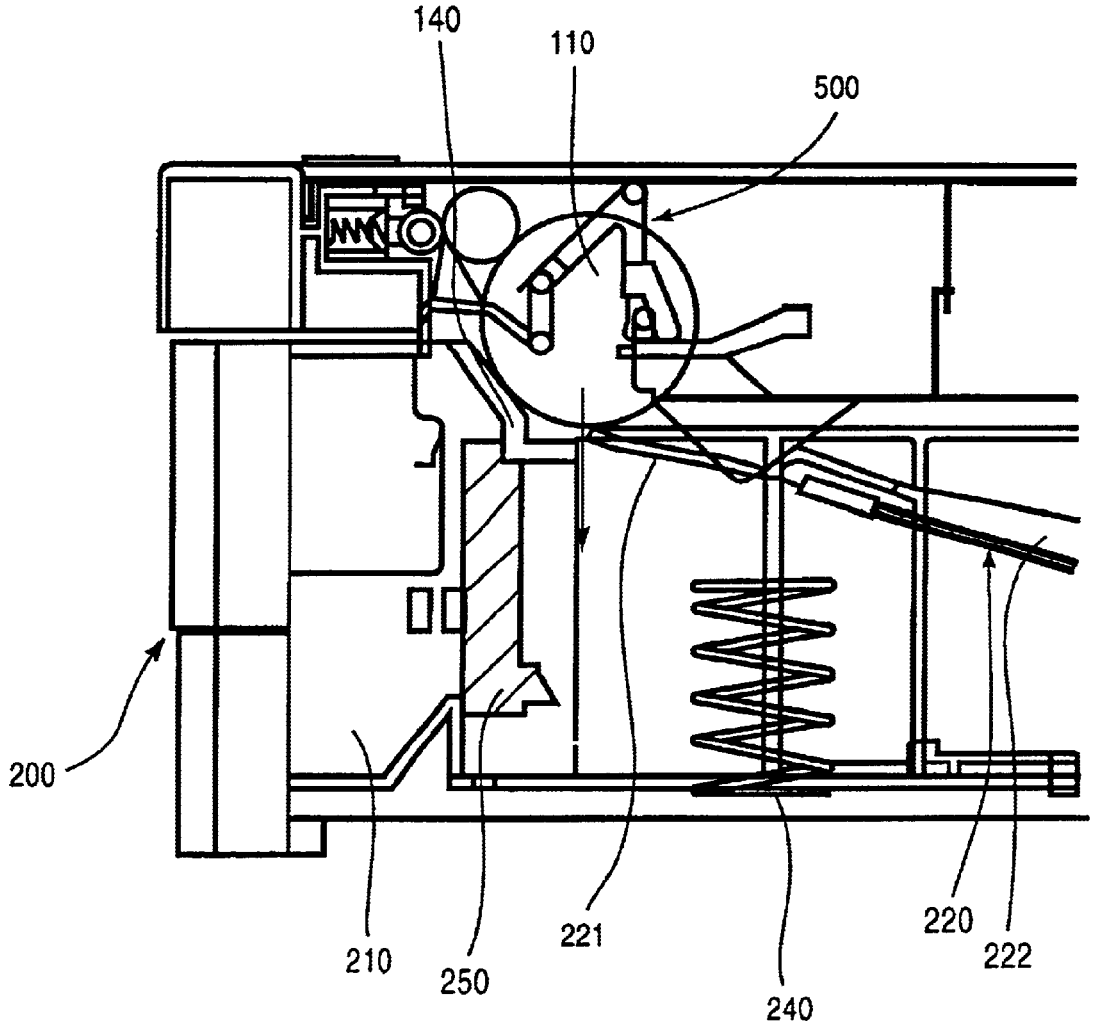
FIG. 22 is a schematic sectional view for explaining a relationship between a lock lever and guide part rib of the image-forming device shown in FIG. 1.

The lock lever 250 is located in the cassette 210 so as to be engageable with a front end portion of the pressure plate 220 via an engagement pawl 252. If the pressure plate 220 is pressed down to the home position, the pressure plate 220 is locked with the engagement pawl 252, and fixed in the home position. The lock lever 250 is configured to utilize a pressing means such as a spring so as not to disengage the engagement pawl 252. When the cassette 210 is completely inserted into the frame 130, the lock lever 250 pivots toward the front by a guide part rib 140 provided in the main body of the image-forming device 100. Consequently, the engagement pawl 252 is disengaged, and the fixed pressure plate 220 is released. FIG. 22 shows an arrangement of the lock lever 250 and the guide part rib 140.

Figure 13:
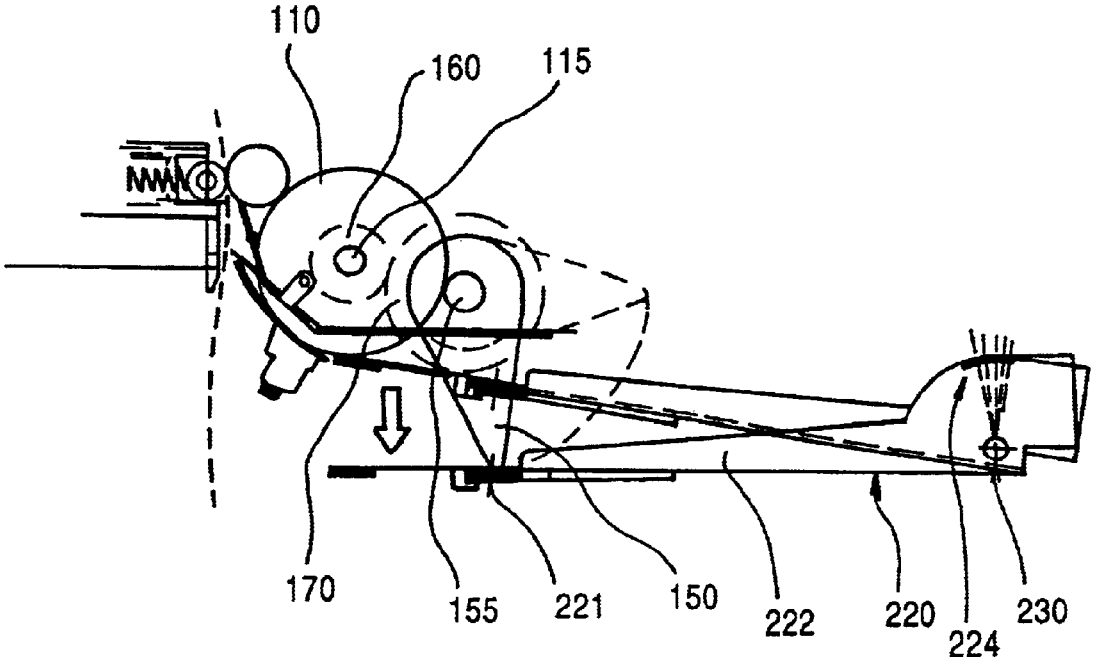
FIG. 13 is a sectional view of the image-forming device for explaining an operation of a cam.

The image-forming device 100 includes a cam 150 serving to push the pressure plate 220 down to the home position. The cam 150 is fixed on a camshaft 155 provided in the image-forming device 100, and located above a front edge side surface of the pressure plate 220. On the camshaft 155 is fixed a gear 170, and the gear 170 is engaged with a gear 160 fixed on the pick roller shaft 115. The gear 170 transmits a rotary driving force of the pick roller shaft 115 to the camshaft 155 in cooperation with the gear 160. The camshaft 155 is driven to rotate, and transmits a rotary force to the coaxial cam 150. The pick roller shaft 115 is driven by a motor 65 in the sheet conveyor mechanism 60 that will be described later with reference to FIG. 21. The cam 150 may move (rotate) between a position indicated by a dashed line and a position indicated by a solid line, as shown in FIG. 13. FIG. 13 is a sectional view for explaining an operation of the cam 150.

The cam 150 shifts the pressure plate 220 to the home position as indicated by the solid line in FIG. 13, and fixes the same slightly below the home position. Thereafter, as the pick roller shaft 115 rotates in a normal direction, the cam 150 goes away to a position indicated by the dotted line in FIG. 13, releases the pressure plate 220 fixed in the home position, and allows a topmost sheet of paper stacked on the pressure plate 220 to be brought into contact with the pick roller 110. A provision of the above cam would facilitate an operation of pushing down the pressure plate. Advantageous effects of the cam will further become apparent in a description that will be given of an operation thereof.

Referring now to FIG. 1 again, a description will be given of a printing part in the image-forming device 100. The printing part 20 of the image-forming device 100 includes a photosensitive drum 30, a charger (not shown), an exposure part (not shown), a development device (not shown), a cleaner (not shown), a transfer unit 80, and a fixing unit 90.

The photosensitive drum 30 includes a photosensitive dielectric layer on a rotatable drum-shaped conductor support, and is uniformly charged by the charger. The photosensitive drum 30, for example, is an OPC made by applying a function separation-type organic photoreceptor on a drum made of aluminum, and rotates at a predetermined circumferential velocity in a predetermined direction.

The (pre-)charger is, for example, comprised of a brush roller charger to which superimposed DC and AC voltages are applied, and gives a constant amount of electric charges (e.g., about −780 V) on a surface of the photosensitive drum 30. The exposure part includes, for instance, a semiconductor laser as a light source, and exposes the surface of the photosensitive drum 30 to light using a laser beam that is irradiated selectively on an area corresponding to an original document. The charge on the surface of the photosensitive drum 30 that has been exposed to light is neutralized (e.g., to about −60V), and a latent image corresponding to imaging data of an image to be recorded.

The development device typically includes a reset roller, a development roller, a (doctor) blade, a toner tank, and a development bias power supply. The development device supplies fine particles of toner supplied from the toner tank to the photosensitive drum 30, and visualizes the latent image formed by the exposure part. The cleaner collects or disposes of toner remaining on the photosensitive drum 30 after the transfer process, or as necessary returns the collected toner to the toner tank. The toner may include one or two components (i.e., it may be a mixture of toner and a carrier) without distinction as to whether it is magnetic or nonmagnetic. In addition, the development roller and the photosensitive drum may, but not necessarily, be brought into contact with each other. The cleaner also serves to remove debris other than toner such as paper, which may be charged and have a detrimental effect on a toner charge, so as to prevent a printing capability from deteriorating. The cleaner may utilize varied kinds of means including magnetic force and rubber friction to remove the toner and charges on the photosensitive drum 30.

The transfer unit 80 generates an electric field to electrostatically adsorb toner, and transfers a toner image adsorbed on the photosensitive drum 30 onto a sheet of paper using a transfer current. The fixing unit 90 fixes the toner image on the sheet of paper that has passed through the transfer unit 80 by applying pressure and heat.

Figure 21:
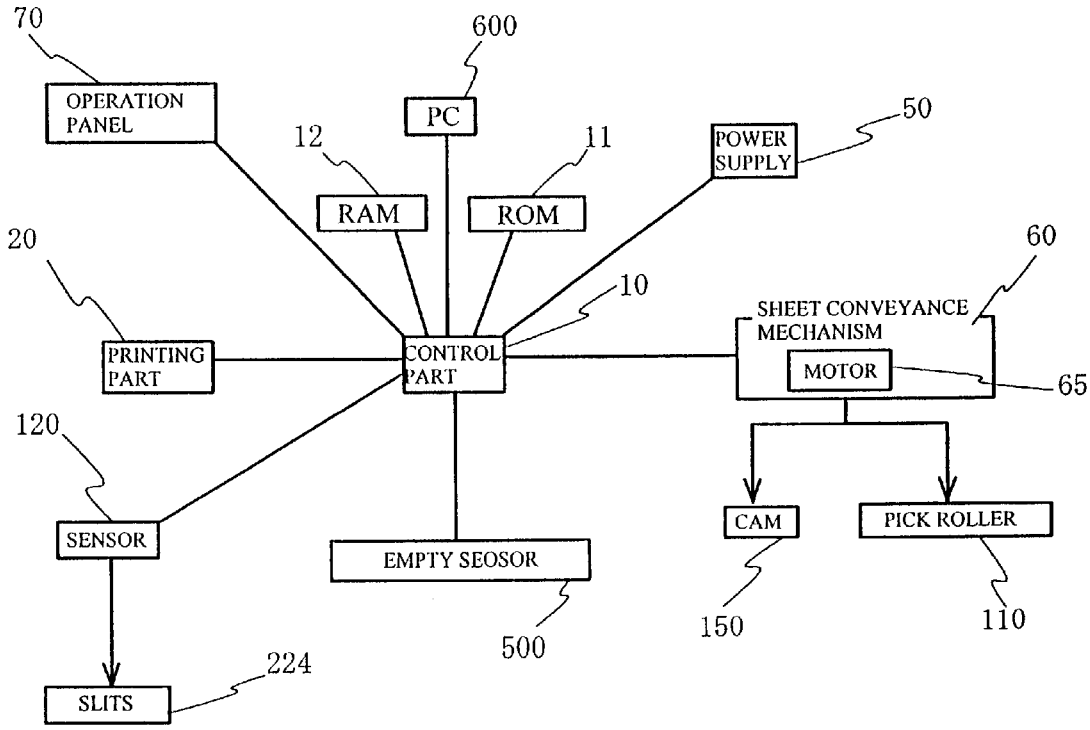
FIG. 21 is a block diagram for explaining a control system of the image-forming device shown in FIG. 1.

Referring now to FIG. 21, a description will be given of a control system of the inventive image-forming device 100. FIG. 21 is a block diagram for explaining the control system of the image-forming device 100. The image-forming device 100 includes a controller 10, and the controller 10 is connected with a ROM 11, a RAM 12, a printing part 20, a sheet conveyor mechanism 60, an operation panel 70, a sensor 120, an empty sensor 500, and a PC 610 (however, the PC 610 comprehensively indicates PCs 600 through 616 shown in FIG. 15), and exerts control over, and/or communicates with these components. The ROM 11 stores a basic program (firmware or the like) necessary for the image-forming device 100 to be operated. The RAM 12 temporarily stores part of data in the ROM 11 or others, or in view of the present invention, data for remaining amount of paper. The controller 10 controls each component of the printing part 20, and controls a printing operation. The controller 10 performs an initial operation for detecting remaining amount of paper as will be described later, when the image-forming device 10 is powered on and derives power from the power supply 50. There are various kinds of motors including the motor 65 in the sheet conveyor mechanism 60, and the controller 10 controls driving of these motors. The controller 10 receives information from the sensor 120 and the empty sensor 500. Additionally, the controller 10 displays a status of the image-forming device 100 in the operation panel 70.

Figure 15:
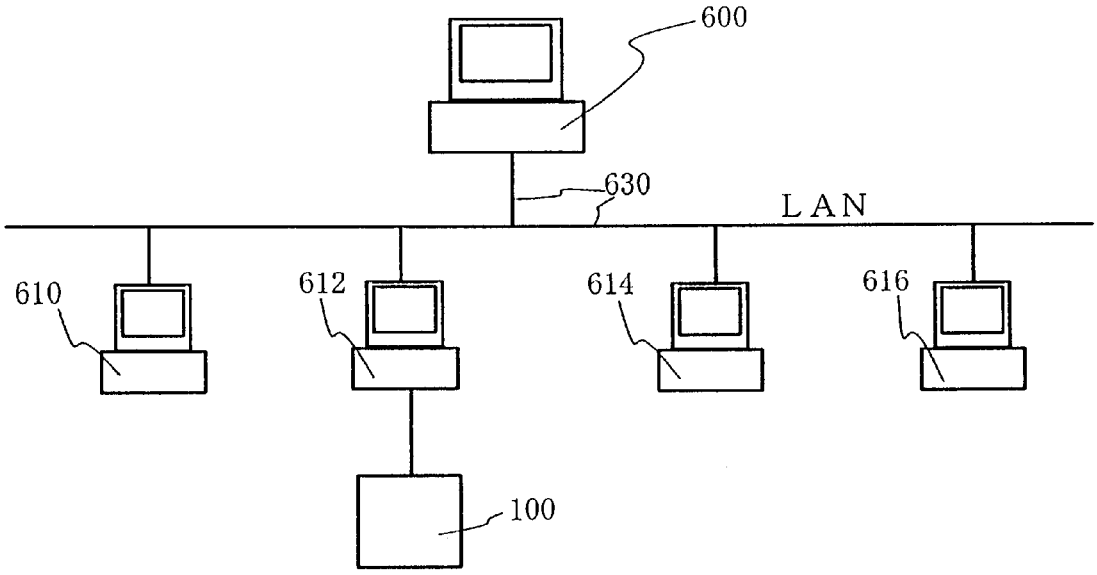
FIG. 15 is a block diagram of a LAN environment in which the image-forming device shown in FIG. 1 is shared among a plurality of PCs.

A description will be given of the operation of the inventive image-forming device 100. The image-forming device 100 may be connected alone with a single PC, or shared among a plurality of PCs in a LAN environment. A description will be given of the operation of the image-forming device 100 in a LAN environment. FIG. 15 is a block diagram where the image-forming device 100 is shared among a plurality of PCs in a LAN environment. Although the LAN may be a peer-to-peer network or a client-server network, the LAN is established herein as a client-server network. Accordingly, each client PC 610 through 616 is connected with a server PC 600 via a LAN cable 630. The image-forming device 100 is exemplarily connected with the client PC 612, and shared among the PC 612 and other PCs.

The controller 10 of the image-forming device 100 may characteristically displays a remaining amount of paper on a display of the PCs 600 through 616 that transmit a print command, and thus each user of the PCs need not make a visual inspection or go to the image-forming device 620 for checking the remaining amount of paper.

Figure 16:
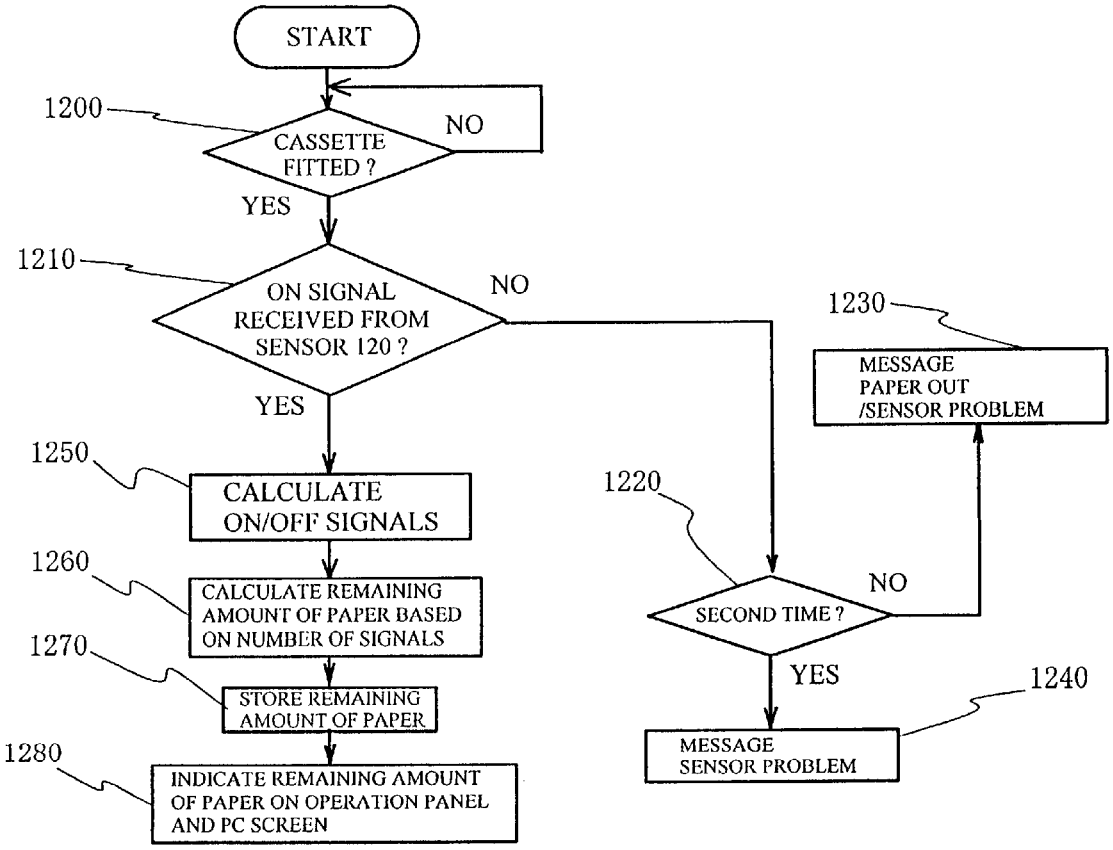
FIG. 16 is a flowchart showing a control of the image-forming device shown in FIG. 1 when a cassette is hot-plugged into the image-forming device.

Referring now to FIG. 16, a description will be given of an operation of the controller 10 detecting a remaining amount of paper, where the cassette 210 is inserted into the frame 130 while power is provided from the power supply 50. FIG. 16 is a flowchart showing a control of the image-forming device shown in FIG. 1 when the cassette is hot-plugged into the image-forming device.

The controller 10 can determine whether the cassette 210 is fitted into the frame 130, utilizing a sensor (not shown). If the controller 10 determines that the cassette 210 is fitted (step 1200), then the controller 10 determines whether an ON signal is received (step 1210).

When the cassette 210 is hot-plugged while power is provided from the power supply 50, a user first sets a batch of paper in the cassette 210, and then inserts the cassette 210 into the frame 130. At this moment, as shown in FIG. 11, the paper guide part 222 of the pressure plate 220 passes through a gap with a width B. The pressure plate 210 is initially located in the home position by the lock lever 250, but when the cassette 210 is completely inserted, the lock lever 250 and the rib 140 are engaged with each other, and the lock lever 250 is released from the pressure plate 220, so that the pressure plate 220 fixed in the home position is released. Consequently, the pressure plate 220 pivots upward from the home position to a position where the topmost sheet of paper is brought into contact with the pick roller 110. At that time, the slit set 224 passes through the sensor 120 in synchronization with the rising pressure plate 220. The sensor 120 may detects the pressure plate 220 in the home position (before shifting) and after shifting. As described above, the slits are arranged on the pressure plate 220 so that the sensor 120 generates an ON signal even if the maximum number of paper is set in the cassette 210. If an ON signal is received in step 1210, the controller 10 follows a process in step 1250.

If an ON signal is not received in step 1210, the controller 10 determines whether this is a second time following the step 1230 (step 1220), and if it is not the second time, displays a no document/sensor abnormal message (step 1230), or if it is the second time, displays a sensor problem message (step 1240).

If an ON signal is received in step 1210, the controller 10 calculates the ON signal and OFF signal (step 1250), and works out a remaining amount of paper utilizing Table 1 or Table 2 that will be described later (step 1260).

Figure 5:
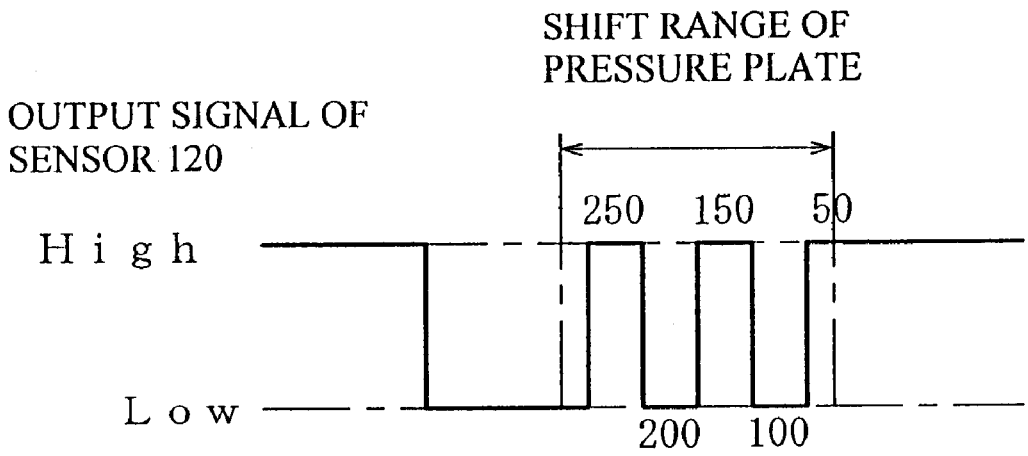
FIG. 5 is a waveform for illustrating an output signal of a sensor when the pressure plate shown in FIG. 4 is used.

A more detailed description will be given of the step 1260, with reference to Table 1 and FIG. 5. Table 1 shows a relationship between the numbers of ON signals and OFF signals, and the number of sheets of remaining paper set in the cassette 210. FIG. 5 is a waveform for illustrating an output signal of the sensor 120 when the pressure plate 220 is used. As shown in FIG. 5, the output signal of the sensor 120 becomes high where the light beam passes through the slit set 224, and low where the light beam is interrupted, and transmits the outputs to the controller 10 respectively as an ON signal and an OFF signal. When the pressure plate 220 is used, the controller 10 can recognize the remaining amount of paper in every 50 sheets.

If the empty sensor 500 is not activated, as nevertheless shown in Table 1, the controller 10 may recognize a loss of paper without performing the operation as shown in FIG. 16. If the empty sensor 500 is not activated, the controller 10 displays a message to instruct to add paper on the operation panel 70, and also transmits the same message to each PC that has issued a print command. Unless the empty sensor 500 is activated, the controller 10 does not execute any print command.

TABLE 1

| OUTPUT SIGNAL OF SENSOR 120 | | REMAINING AMOUNT OF |
|---|---|---|
| NUMBER OF OFF SIGNALS | NUMBER OF ON SIGNALS | PAPER (NUMBER OF SHEETS) |
| 1 | 1 | 250 |
| 2 | 1 | 200 |
| 2 | 2 | 150 |
| 3 | 2 | 100 |
| 3 | 3 | 50 |
| IF EMPTY SENSOR 500 IS NOT ACTIVATED | | 0 |

Figure 7:
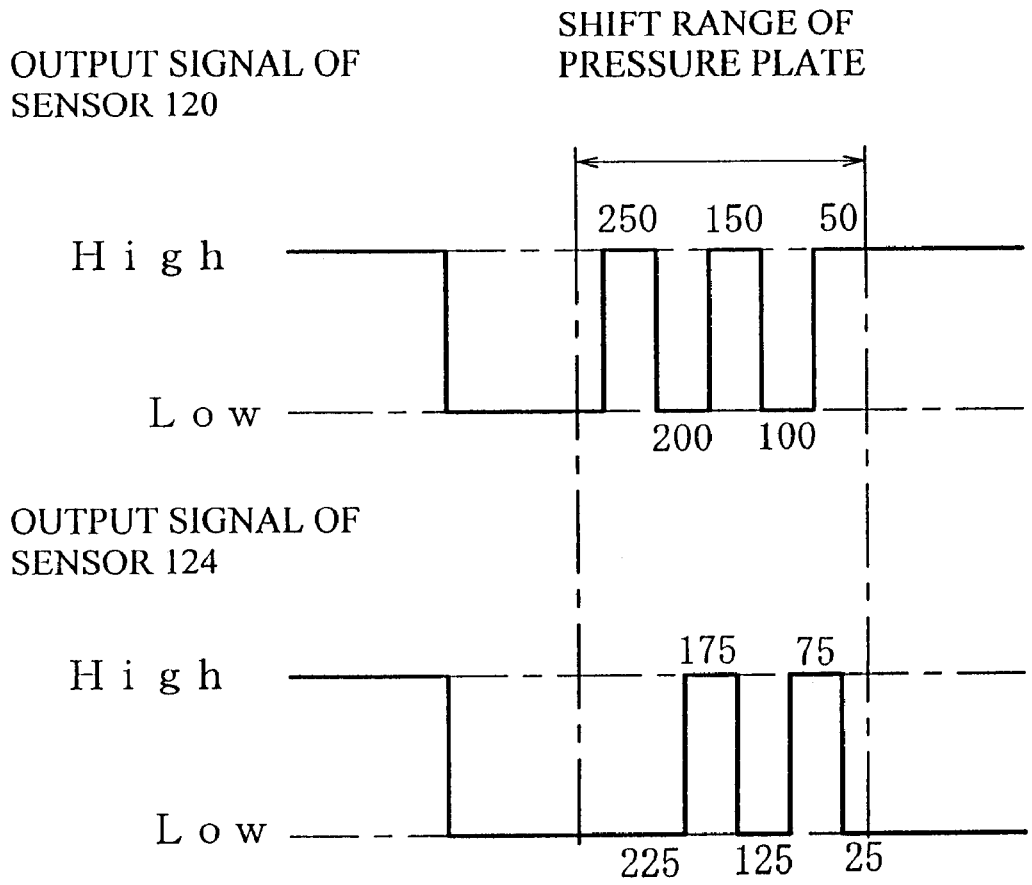
FIG. 7 is a waveform for illustrating an output signal of a sensor when the pressure plate shown in FIG. 6 is used.

A description will be given of a method of detecting remaining amount of paper using the controller 10 when a pressure plate 420 is used instead of the pressure plate 220, with reference to Table 2 and FIG. 7. Table 2 shows a relationship between the numbers of ON signals and OFF signals generated by the sensors 122 and 124 provided instead of the sensor 120, and the number of sheets of remaining paper set in the cassette 210. FIG. 7 is a waveform for illustrating an output signal of the sensors 122 and 124 when the pressure plate 420 is used. When the pressure plate 420 is used, the controller 10 can recognize the remaining amount of paper in every 25 sheets, and thus exhibit an improved detection accuracy of the remaining amount of paper, as may be apparent from Table 2 and FIG. 7, compared with the embodiment as shown in Table 1 and FIG. 5.

TABLE 2

| OUTPUT SIGNAL OF SENSOR 122 | | OUTPUT SIGNAL OF SENSOR 124 | | REMAINING AMOUNT OF PAPER |
|---|---|---|---|---|
| OFF SIGNALS | ON SIGNALS | OFF SIGNALS | ON SIGNALS | (NUMBER OF SHEETS) |
| 1 | 1 | 0 | 0 | 250 |
| 1 | 1 | 1 | 0 | 225 |
| 2 | 1 | 1 | 0 | 200 |
| 2 | 1 | 1 | 1 | 175 |
| 2 | 2 | 1 | 1 | 150 |
| 2 | 2 | 2 | 1 | 125 |
| 3 | 2 | 2 | 1 | 100 |
| 3 | 2 | 2 | 2 | 75 |

TABLE 2-continued

| OUTPUT SIGNAL OF SENSOR 122 | | OUTPUT SIGNAL OF SENSOR 124 | | REMAINING AMOUNT OF PAPER |
|---|---|---|---|---|
| OFF SIGNALS | ON SIGNALS | OFF SIGNALS | ON SIGNALS | (NUMBER OF SHEETS) |
| 3 | 3 | 2 | 2 | 50 |
| 3 | 3 | 3 | 2 | 25 |
| IF EMPTY SENSOR 500 IS NOT ACTIVATED | | | | 0 |

Thereafter, the remaining amount of paper that has been worked out is stored in the RAM 12. It is the number of remaining sheets of paper actually set in the cassette 210 that is stored in the RAM 12. If necessary, the remaining amount of paper stored in the RAM may be displayed on PCs that has not issued a print command, and on the operation panel 70 (step 1280), but it is optional whether the step 1280 is provided or not. If the step 1280 follows, a user who is sending a print command may be notified of the remaining amount of paper on his/her PC screen. Consequently, if the user determines that paper should be added, he/she adds paper in the cassette 210. When the cassette is set, the controller 10 repeats the above operations.

Figure 14:
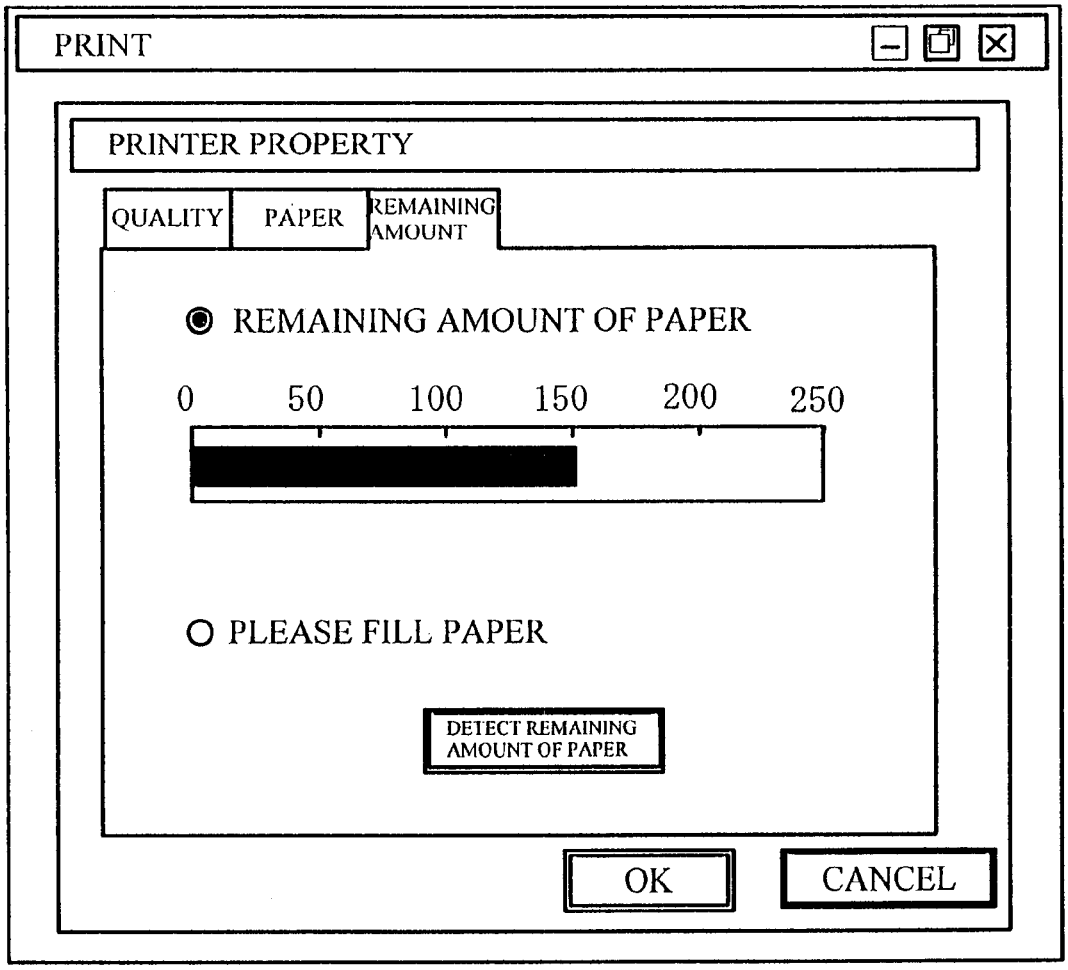
FIG. 14 is an example of a display for a remaining amount of paper.

When the remaining amount of paper is to be displayed on the PC 610 that has issued a print command, the controller 10 transmits data required for a printer driver for the image-forming device 100 stored in a hard disk drive or the like (not shown) in the PC 610. Consequently, the printer driver is enabled to indicate the remaining amount of paper in a printer property screen as shown in FIG. 14. The printer driver may be distributed and updated via a computer-readable medium, and the Internet or other commercial communications network (e.g., America Online). Since the printer driver may be distributed and updated utilizing techniques known in the art, a detailed description will be omitted herein. When the remaining amount of paper is to be displayed on the PCs that have not issued a print command, pertinent information may be indicated, for example, on the task bar in each PC. According to this configuration, users may easily check the remaining amount of paper, regardless of whether the users are to execute printing.

According to the above procedural steps, as far as the image-forming device 100 has been powered from the power supply 50, the number of sheets of paper in the cassette 210 may be detected when the cassette 210 is inserted. In contrast, while the image-forming device 100 is not powered from the power supply 50, the sensor 120 and the controller 10 are disabled. All the while, if the user fills paper in the cassette 210 and fits the cassette 210 into the frame 130, the lock lever 250 is released by the rib 140 and the pressure plate 220 is brought into contact with the pick roller 110, but the changed shift amount of the pressure plate 220 is not detected because the controller 10 and the sensor 210 are disabled. Even if the power supply 50 were thereafter turned on, the sensor could not detect the change in a tilt amount of the pressure plate 220 relative to the home position. In addition, the RAM 12 erases the remaining amount of sheets stored therein when turned off.

In order to detect the addition of paper made while the power supply 50 is off, it is conceivable that only a necessary circuit for detecting the remaining amount of paper is energized constantly, while the main body of the image-forming device 100 is not powered from the power supply 50. This type of power is often called a standby power. However, in view of the fact that it is not practically sufficient only to detect the remaining amount of paper but also to store and display the remaining amount for users, the circuits to be energized would be spread to the controller 10, ROM 11, RAM 12, operation panel 70, and sensor 120.

Therefore, the image-forming device 100 of the present invention is configured to detect the remaining amount of paper only when the power supply 50 is on in terms of a saving in the standby power. The inventive image-forming device 100 deals with the change in the remaining amount of paper while the power is off.

Figure 17:
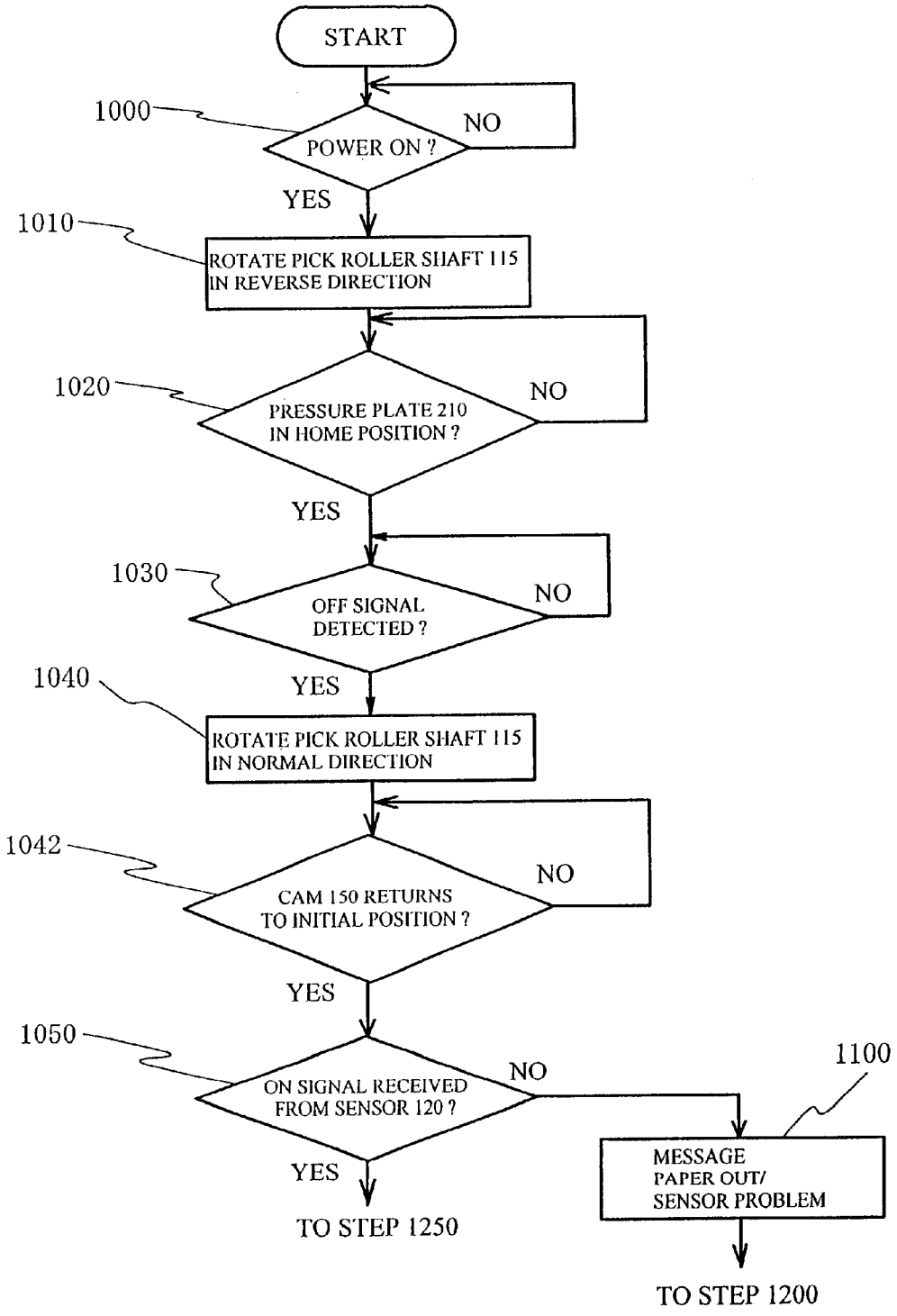

Referring now to FIG. 17, a description will be given of an operation of the controller 10 that detects the remaining amount of paper when the power is turned on. FIG. 17 is a flowchart showing a control of the image-forming device 100 when the image-forming device 100 is powered on.

When the power supply 50 for the image-forming device 100 is turned on (step 1000), the image-forming device 100 starts detecting the remaining amount of paper in the cassette 210 as an initial operation. The controller 10 controls the motor 65, and drives the pick roller shaft 115 to rotate in a reverse direction (step 1010). Consequently, the gear 160 on the pick roller 115 rotates, too. Accordingly, the gear 170 meshed with the gear 160 rotates clockwise, and the gear 170 rotates the cam 150 along with the camshaft 155. The cam 150, as rotating, presses the pressure plate 220 downwardly. The cam 150 presses the pressure plate 220, as indicated by a solid line in FIG. 13, down to the vicinity of the home position (more specifically, to a position a little below the home position). The controller 10 determines based upon information from a sensor (not shown) that detects a rotation angle of the cam 150 or a position of the pressure plate 220 whether the pressure plate 220 is shifted to the home position (step 1020).

From the fact that the sensor 120 detects an OFF signal, the controller 10 determines that the pressure plate 220 is positioned a little below the home position (step 1030), and controls the motor 60 upon receipt of the OFF signal to rotate the pick roller shaft 115 in a normal direction (step 1040). Accordingly, the pressure plate 220 rises, and the slit set 224 thus passes through the sensor 120. As described above, the sensor 120 generates an ON signal in the home position, and even if a maximum number of paper is set in the cassette 210, the pressure plate 220 shifts from a position a little below the home position to the home position until the topmost sheet is brought into contact with the pick roller 110; thus the sensor 120 generates at least one ON signal all that while.

The controller 10 is informed of a rotation angle of the cam 150, and thereby determines whether the cam 150 returns an initial position (step 1042), and rotates the pick roller shaft 115 in a normal direction until the controller 10 determines that the cam 150 has returned to the initial position (step 1040).

When the controller 10 determines that the cam has returned to the initial position (step 1042), the controller 10 determines whether an ON signal has been received from the sensor 120 (step 1050). If the controller 10 receives no ON signal, but only an OFF signal, then the controller 10 displays a loss of paper/sensor problem message, and prompts a user to check paper in the cassette 210. If the user draws out the cassette 210 while the power supply 50 is on to fill paper into the cassette 210, the process goes to the above step 1200. If the user turns off the power supply 50 of the image-forming device 100 and draws out the cassette 210, and turns on the power supply 50 again, the process starts again from the step 1000. If the controller 10 receives an ON signal, the process subsequently goes to the step 1250.

The image-forming device 100 of the present invention is configured to detect a remaining amount of paper at any time except when the cassette 210 is not inserted, or when printing is being executed. As shown in FIG. 14, a user clicks a button that reads 'detect remaining paper amount' with a mouse, or presses a key to which the same command is assigned on a keyboard, and thereby transmits to the controller 10 the command to detect the remaining paper amount. When the controller 10 receives the command to detect the remaining amount of paper from the PC 600 or the operation panel 70, the step 1010 and subsequent steps in the above-described detecting process when the power is turned on are executed. Since the steps 1010 and subsequent steps are the same as those executed when the power is turned on, a detailed description will be omitted herein. Moreover, such a configuration as to detect a remaining amount of paper, even while printing is being executed, by suspending the printing may be applied. By applying the above configuration, not only a user who has issued a print command but also users who have not issued any print command may check the remaining amount of paper.

Figure 18:
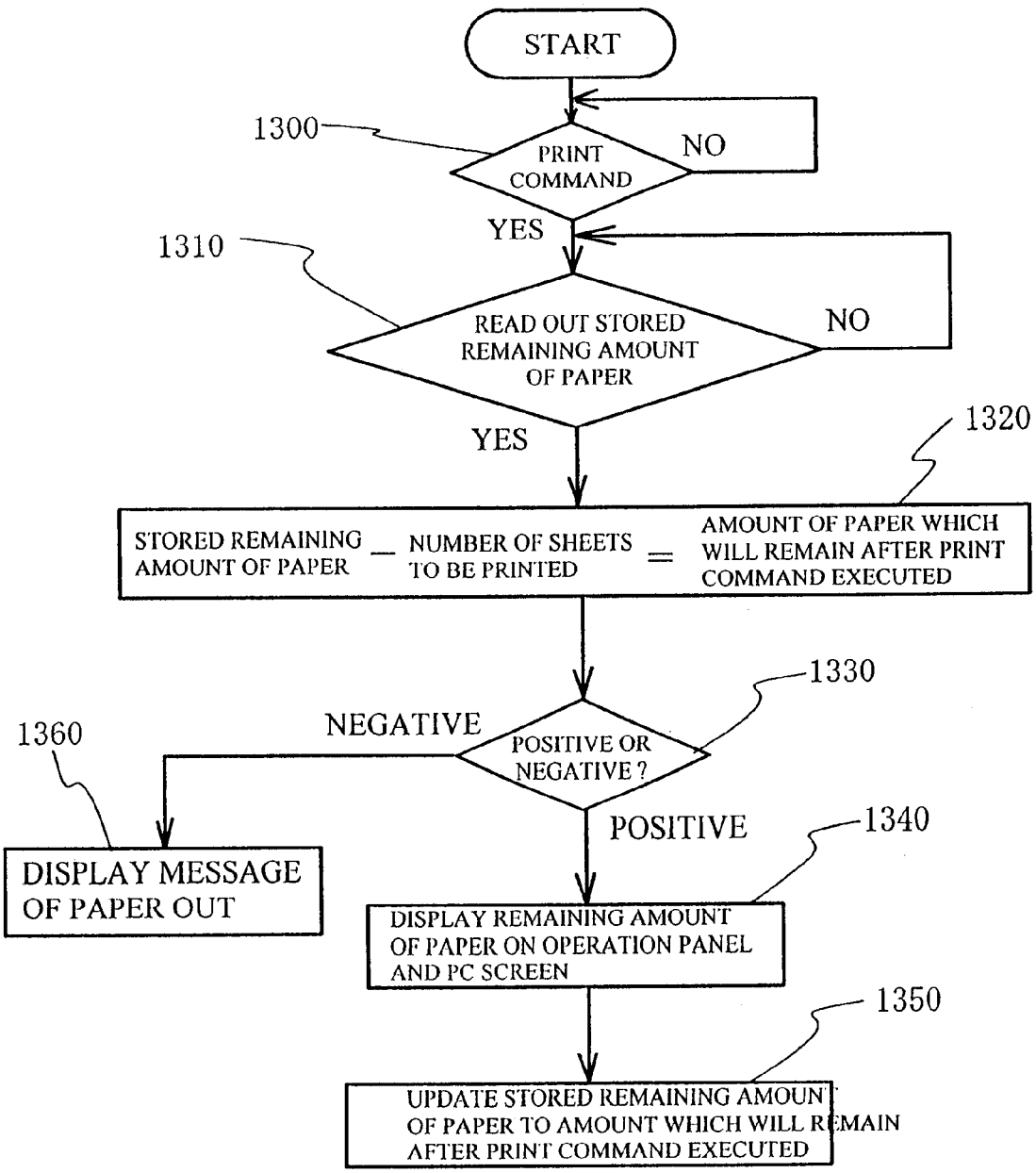
FIG. 18 is a flowchart showing a control of the image-forming device shown in FIG. 1 when the image-forming device receives a print command.

Referring next to FIG. 18, a description will be given of process when a user of the PC 610 issues a print command. FIG. 18 is a flowchart showing a control by the controller 10 when the image-forming device 100 receives a print command. When a print command is received from the PC 610 through the LAN cable 630, a hub (not shown), the PC 612, and a printer cable (not shown), and other USB cables (step 1300), the controller 10 reads out the remaining amount of paper stored in the RAM 12 (step 1310), calculates a formula of STORED REMAINING AMOUNT OF PAPER—NUMBER OF SHEETS TO BE PRINTED, and calculates an amount of paper which will remain after the print command has been executed (step 1320). Next, a determination is made as to whether the amount of paper which will remain after the print command has been executed is positive or negative (step 1330). If the amount of paper which will remain after the print command has been executed is positive, the controller 10 displays the amount of paper on the operation panel 70 and the display of the PC 610 (step 1340), and updates a remaining amount of paper stored in the RAM 12 to the amount of paper which will remain after the print command has been executed (step 1350). On the other hand, if the amount of paper which will remain after the print command has been executed is negative, the controller 10 displays a message that paper is running out as shown in FIG. 14 (step 1360). In response thereto, the user may add paper in the cassette 210 before printing starts. When paper is filled in the cassette 210, and the cassette 210 is fitted into the frame 130, the process as shown in FIG. 16 is repeated. Then, unless the user cancels the print command, the controller 10 voluntarily sends remaining print commands to execute the process shown in FIG. 18. In operation as shown in FIG. 18, the 'stored remaining amount of paper' is the remaining amount of paper after the cassette 210 is inserted which is detected and stored (step 1270) as shown in FIG. 16. In addition, the 'number of paper to be printed' in step 1320 is the number of paper which a user has issued a command to print.

When the user continues to execute a print command, regardless of a loss of paper message which has been displayed (step 1360), the controller 10 executes the print command as far as paper remains. When the paper runs out, the above-described empty sensor 500 is turned off, and no further printing is conducted. In addition, a message to fill paper is displayed at the same time. In response thereto, the user adds paper into the cassette 210. When the paper is added into the cassette 210, and the cassette 210 is fitted into the frame 130, the process as shown in FIG. 16 is repeated. Thereafter, the controller 10 voluntarily issues a print command for the remaining amount of paper to print on newly added sheets of paper, and the process as shown in FIG. 18 is carried out. In operation as shown in FIG. 18, the 'stored remaining amount of paper' is the remaining amount of paper which is detected and stored (step 1270) as shown in FIG. 16. In addition, the 'number of paper to be printed' in step 1320 is the number of paper which is to be printed but has not yet been printed.

According to the control flowchart, the RAM 12 stores not only the current number of remaining amount of paper, but also the number of remaining amount of paper in the future (i.e., after print command has been complete). This feature is preferable especially in a LAN environment. For instance, when the current number of remaining amount of paper is one hundred, and a user of the PC 610 transmits a print command for sixty sheets after a user of the PC 614 transmits a print command for fifty sheets, the remaining amount of paper stored in the RAM 12 in step 1320 is not one hundred, but is updated to forty due to step 1350 carried out for the PC 614. Consequently, the step 1320 carried out for the PC 610 outputs a negative value, and the user of the PC 610 receives a message that paper is running out in step 1360. The user of the PC 610 may receive such information on the display of the PC 610 that he/she operates.

The RAM 12 may store two values of the remaining amounts of paper: i.e., the number of paper that remains at present, and the number of paper that will remain in the future. This configuration would enable two values of remaining amounts of paper to be displayed, allowing a user to be notified of the status of the remaining amounts of paper more specifically.

If the cassette 210 stores an amount of paper enough to have print commands executed completely, the controller 10 executes a printing operation by controlling the sheet conveyor mechanism 60 and the printing part 20. In the printing operation, first of all, the charger uniformly and negatively electrifies the photosensitive drum 30 (at about −780V). Next, a laser beam is emitted from the exposure part onto the photosensitive drum 30, and uniform charge on the photosensitive drum 30 is eliminated in areas corresponding to an image due to exposure to light by the laser beam, and thereby a latent image is formed. Thereafter, the latent image is developed using the development device.

In the development device, the development roller in contact with the photosensitive drum 30 rotates in the same direction as the photosensitive drum 30, and toner supplied from the reset roller forms a toner layer on the development roller while a toner layer thickness is regulated by a blade. A development bias power supply applies a voltage of −450V to the reset roller, −350V to the development roller in the development device. To the blade is applied a voltage of −350V. Thanks to stable toner charge, a stable toner layer is formed on the development roller irrespective of the number of sheets to be printed. Thereafter, the toner layer formed on the development roller is deposited onto the electrostatic latent image area on the photosensitive drum 30 by the development bias voltage and developed. Toner that has not contributed to the development is flaked off by the reset roller that rotates in an opposite direction below the development roller, and returned through a lower side of the reset roller to the toner tank.

The toner image on the photosensitive drum 30 obtained by the development device is transferred on a sheet of printing paper that has been timely conveyed from the above-described feeder 200. The residual toner on the photosensitive drum 30 is collected by a cleaner. The printing paper on which the image has been transferred passes through the fixing roller in the fixing unit 90, where the image is fixed on the paper, and is ejected out.

The above image-forming device 100 as a laser printer is only an exemplified embodiment that uses the inventive feeder 200. The inventive feeder 200 is applicable to all devices requiring a sheet feeder mechanism. An image-forming device such as an impact printer, an inkjet printer, or the like, and a printing device such as a photocopier or the like are examples of the applicable devices.

Figure 19:
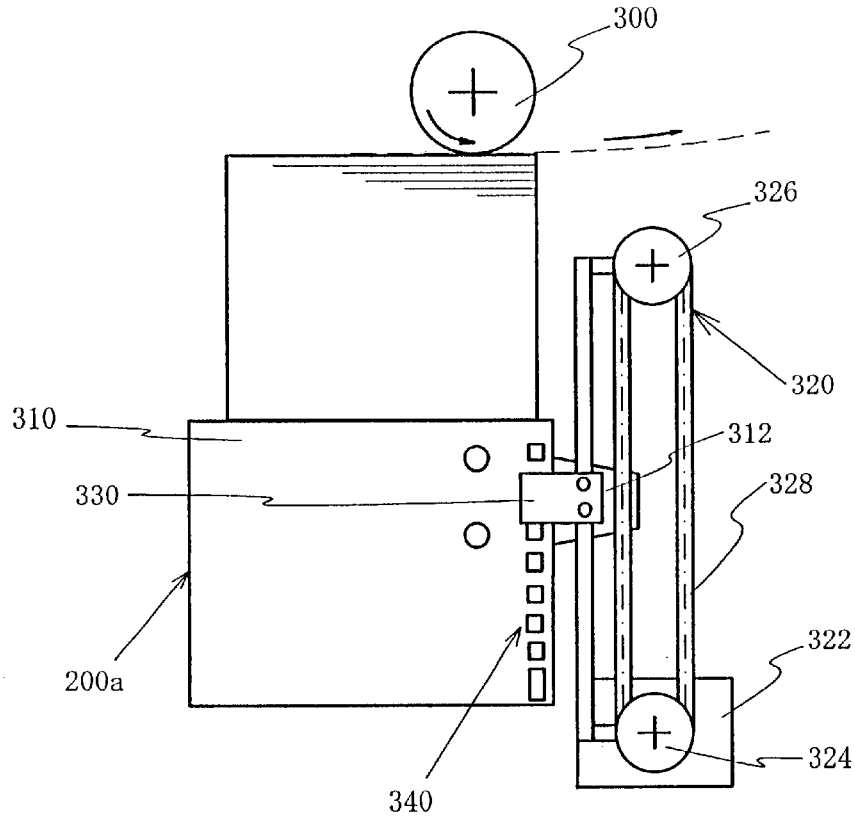
FIG. 19 is a schematic sectional view of a feeder as another exemplified embodiment of the present invention.

A description will now be given of another embodiment of the feeder 200*a* according to the present invention, with reference to FIG. 19. FIG. 19 is a schematic sectional view of the feeder 200*a* as another exemplified embodiment of the present invention. The feeder 200*a,* like the feeder 200, may be used for a feeder in an image-forming device. The feeder 200*a* is comprised of a tray 310, and a slit set 340 formed at a side of the tray 310. The tray 310 is a housing on which sheets of paper are placed, and can accommodate a large amount of paper. The tray 310 may vertically move by a tray hoisting and lowering device 320. While the feeder 200 employs the pressure plate 220 as a paper placement part coupled so as to shift in the cassette 210 for introducing a sheet of paper into the sheet conveyor mechanism, the tray 310 itself moves and thereby performs an operation to introduce a sheet of paper into the sheet conveyor mechanism. Therefore, the tray 310 serves as the paper placement part for introducing a sheet of paper into the sheet conveyor mechanism. When sheets of paper are to be placed, the tray 310 is shifted to the lowest position (hereinafter referred to as a home position). When sheets of paper have been placed, the tray 310 is shifted until the top of the sheets is brought into contact with the pick roller 300.

The tray hoisting and lowering device 320 typically includes a driving means 322, a transmission roller 324, 326, and a transmission belt 328. The tray hoisting and lowering device 320 vertically shifts the tray 310, so that the tray 310 may reciprocate between the home position and the top position. The tray hoisting and lowering device 320 also serves to stop the tray 310 when the top of the sheets is brought into contact with the pick roller 300.

The driving means 322 transmits a driving force directly or indirectly, and is comprised of a motor that rotates a shaft 325 (not shown), and the like. The transmission roller 324 is engaged with the shaft 325, and rotates by rotation of the shaft 325. The transmission roller 326 is engageable with a shaft 327 (not shown) to rotate on the shaft 327. As shown in the figure, the transmission belt 328 is looped over the transmission rollers 324 and 326. As the transmission roller 324 rotates, the transmission belt 328 rotates around the rollers and transmits the rotation between the shafts by friction forces with the transmission rollers 324 and 326. In order to transmit a rotary force efficiently, the friction forces between the transmission rollers 324/326 and the transmission belt 328 are preferably made larger. Materials for the transmission belt 328 need be determined with consideration given to a load of paper on the tray 310. Typically among usable materials are leather, rubber, a steel plate, or the like. The transmission rollers 324 and 326 provided with grooves, and the transmission belt 328 V-shaped or made as a timing belt could transmit a rotary force more efficiently.

Referring again to FIG. 19, the tray 310 and the transmission belt 328 are coupled with a joint part 312. The rotation of the transmission belt 328 enables the tray 310 to move vertically. However, as far as the tray 310 is allowed to move vertically, a method of driving the tray 310 is not limited to the above.

The sensor 330 is located on the tray 310, and detects a vertical shift amount of the tray 310 in cooperation with the slit set 340. Since the sensor 330 has substantially the same structure as the sensor 120 in the feeder 200, a detailed description will be omitted herein.

Figure 20:
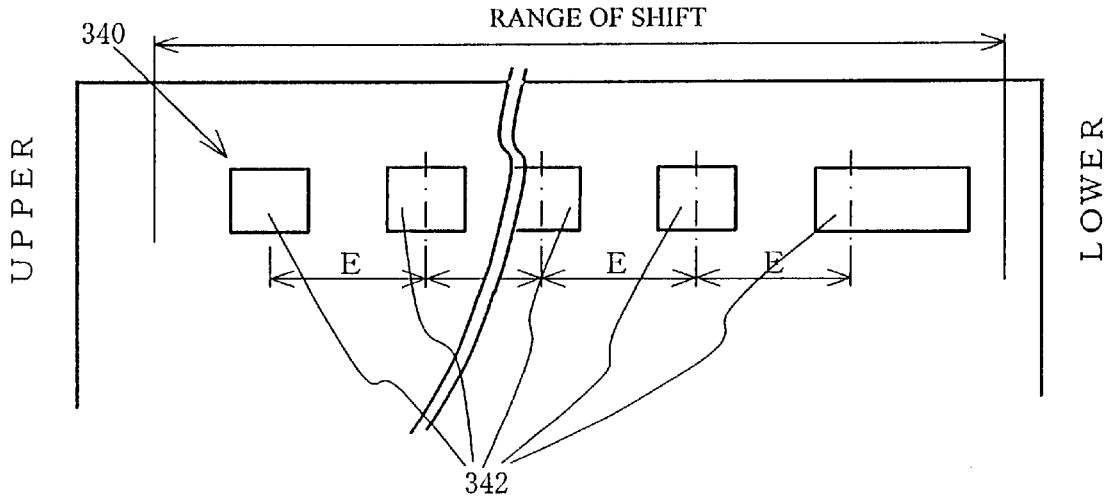
FIG. 20 is an enlarged schematic plan view of a slit set shown in FIG. 19 for explaining an arrangement of slits.

The slit set that is a shift amount indicator part includes slits 342, which are located within a range that the sensor 330 can detect. An arrangement of the slits 342 of the slit 340 is shown as a magnified view in FIG. 20. The sensor 330 may detect the slits 342 that move with the tray 310, as shown in FIG. 20. A distance E is equal to a width of a thickness of a batch of sheets the number of which corresponds to a unit interval of the detection of a remaining amount of paper. If the remaining amount of paper is to be detected every fifty sheets, the distance E corresponds to a shift amount of the tray 310 when fifty sheets are printed. Since the slit set 340 exerts the same effects as the slit set 224, a detailed description will be omitted herein. The number of slits is determined according to the number of sheets the tray 310 can accommodate. As the sensor 330 and the slit set 340 have been described only for purposes of illustration, the shape, arrangement, and detecting method thereof are not limited to such as described above, and may be configured differently as far as an amount of the vertical movement of the tray 310 can be detected.

A description will now be given of a method of detecting a remaining amount of paper using the feeder 200*a* of the present invention. The feeder 200*a* performs the detection of a remaining amount of paper every time when sheets of paper are newly placed and when an image-forming device or the like provided with the feeder 200*a* is powered on.

When the image-forming device is powered on, the feeder 200*a* pushes the tray 310 down to the home position. In that event, the sensor 330 detects a position above the topmost slit, and generates an OFF signal. When the tray 310 reaches the home position, the tray 310 start rising again. Simultaneously with the rising operation, the sensor 330 starts detecting. The tray 310 rises until the topmost sheet on the tray 310 is brought into contact with the pick roller 300. The sensor 330 continues detecting all that while, and stops detecting when the tray 310 stops. Since this detecting method is the same as that of the feeder 200, a detailed description will be omitted.

When sheets of paper are placed on the tray 310, the tray 310 is moved to the home position. Referring to FIG. 20, at that time, the sensor 330 is positioned above the topmost slit, and generates an OFF signal. Thereafter, the tray 310 is moved upward to bring the sheets into contact with the pick roller 300. At that time, the sensor 330 starts detecting. The tray 310 rises until the topmost sheet is brought into contact with the pick roller 300. The sensor 330 continues detecting all that while, and stops detecting when the tray 310 stops. The foregoing process is the same as that of the feeder 200. Therefore, a detailed description thereof will be omitted.

Although the preferred embodiments of the present invention have been described above, various modifications and changes may be made in the present invention without departing from the spirit and scope thereof.

As described above, according to the image-forming device of the present invention, the shift amount indicator part electrically provides information, and thus a remaining amount of paper may efficiently and reliably be informed.

According to the image-forming device of the present invention, a remaining amount of paper stored in the paper placement part may be relatively cost-effectively calculated with a simple structure. The remaining amount detecting method of the present invention defines a remaining amount of paper at the time when the device receives a print command, and may thus recognize the amount of paper that will remain after the print command is completely executed, to prepare for a loss of paper. Such a configuration is convenient especially when a plurality of print commands would be concurrently transmitted in a network environment such as a LAN.

What is claimed is:

1. A feeder that feeds a recordable medium to a processor part that performs a process, comprising:

a sheet placement part that can accommodate a plurality of the recordable media in a stack of layered sheets, and rotate and shift to a suitable position for feeding the recordable media to the processor part; and a shift amount indicator part that is configured to rotate in a direction of rotation of the sheet placement part as the sheet placement part rotates, so as to enable a shift amount of the sheet placement part corresponding to a remaining amount of the recordable media to be electrically transmitted to an external device, wherein the shift amount indicator part includes a plurality of slits that constitute a part of the sheet placement part.

2. A feeder according to claim 1, wherein the shift amount indicator part and the sheet placement part are integrally formed.

3. A feeder according to claim 1, wherein the shift amount indicator part is an encoder that constitutes an integral part of the sheet placement part and indicates the shift amount of the sheet placement part.

4. A feeder according to claim 3, wherein the shift amount indicator part includes multi-tier slits, each tier being different in topology, and slits of each tier have a different width indicating a range of the remaining amount of the recording media.

5. A feeder comprising:

a sheet placement part that can accommodate a plurality of recordable media in a stack of sheets, and that can linearly move in a direction in which the recordable media are stacked, to introduce the recordable media into a sheet conveyor mechanism; and a shift amount indicator part that enables a shift amount of the sheet placement part to be electrically transmitted to an external device, wherein the shift amount indicator part includes a plurality of slits that constitute a part of the sheet placement part.

6. An image-forming device comprising:

a feeder including a sheet placement part that can accommodate a plurality of the recordable media in a stack of layered sheets, and rotate and shift to a suitable position for feeding the recordable media, and a shift amount indicator part that is configured to rotate in a direction of rotation of the sheet placement part as the sheet placement part rotates, so as to indicate a shift amount of the sheet placement part;

a printing part that performs printing onto the recordable media;

a sheet conveyor mechanism that conveys the recordable media fed from the sheet placement part in the feeder through the printing part;

a detector that detects the shift amount of the sheet placement part indicated by the shift amount indicator part;

a controller that calculates a remaining amount of the recordable media stored in the sheet placement part based upon the shift amount of the sheet placement part detected by the detectors, a dispenser mechanism that dispenses the recordable media from the sheet placement part to the printing part; and a shift mechanism that shifts the sheet placement part to a home position, wherein the sheet placement part is configured to be shiftable from the home position in which the recordable media comes into contact with the dispenser mechanism, and wherein the detector detects the shift amount of the sheet placement part from the home position to the position in which the recordable media comes into contact with the dispenser mechanism.

7. An image-forming device according to claim 6, wherein the shift mechanism includes a cam, and the dispenser mechanism drives the cam in a direction opposite to a dispensing direction of the recordable media from the sheet placement part to the printing part, so that the sheet placement part shifts to the home position.

* * * * *